US012497228B2

(12) United States Patent
Yamada

(10) Patent No.: US 12,497,228 B2
(45) Date of Patent: Dec. 16, 2025

(54) CORNER PROTECTOR

(71) Applicant: FUJIFILM Business Innovation Corp., Tokyo (JP)

(72) Inventor: Keigo Yamada, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 18/632,262

(22) Filed: Apr. 10, 2024

(65) Prior Publication Data

US 2025/0136344 A1 May 1, 2025

(30) Foreign Application Priority Data

Oct. 27, 2023 (JP) ..... 2023-184443

(51) Int. Cl.
*B65D 81/05* (2006.01)

(52) U.S. Cl.
CPC ..... *B65D 81/054* (2013.01); *B65D 81/057* (2013.01); *B65D 81/058* (2013.01); *B65D 2581/053* (2013.01)

(58) Field of Classification Search
CPC .. B65D 81/054; B65D 81/057; B65D 81/058; B65D 2581/053
USPC ..... 206/586
See application file for complete search history.

(56) References Cited

U.S. PATENT DOCUMENTS 3,653,496 A * 4/1972 Roberts ..... B65D 81/057 206/326
3,900,156 A * 8/1975 Clark, Jr. ..... B65D 81/056 206/586
4,162,729 A 7/1979 Kaiser et al.
4,529,091 A * 7/1985 Martin ..... B65D 81/056 206/453
6,012,587 A * 1/2000 McCullough ..... B65D 81/054 493/137
7,913,896 B2 * 3/2011 Reinkensmeyer ..... B65D 5/445 229/199
2006/0081496 A1 * 4/2006 Carter ..... B65D 81/054 206/586
2016/0059433 A1 * 3/2016 Ulrich ..... B26F 1/12 29/897

FOREIGN PATENT DOCUMENTS

| | | |
|---|---|---|
| CN | 219584874 | 8/2023 |
| DE | 2842988 | 4/1979 |
| JP | 2004175425 | 6/2004 |
| JP | 2006131235 | 5/2006 |
| JP | 4186104 | 11/2008 |
| JP | 2020117270 | 8/2020 |
| JP | 7265245 | 4/2023 |

OTHER PUBLICATIONS

"Search Report of Europe Counterpart Application", issued on Oct. 8, 2024, pp. 1-8.
"Office Action of Europe Counterpart Application", issued on Aug. 11, 2025, pp. 1-3.

* cited by examiner

*Primary Examiner* — Steven A. Reynolds
(74) *Attorney, Agent, or Firm* — JCIPRNET

(57) ABSTRACT

A corner protector includes two surface portions having a rectangular shape and interposing a bent portion extending parallel to one side; a notch reaching the bent portion from one side of at least one surface portion of the two surface portions; and a folding line reaching one side of the other surface portion from a terminal end of the notch.

18 Claims, 33 Drawing Sheets

CORNER PROTECTOR

CROSS-REFERENCE TO RELATED APPLICATIONS

This application is based on and claims priority under 35 USC 119 from Japanese Patent Application No. 2023-184443 filed Oct. 27, 2023.

BACKGROUND

(i) Technical Field

The present invention relates to a corner protector.

(ii) Related Art

JP4186104B (Claim 1 and FIGS. 1 and 2) describes a sheet for preventing load collapse, which is formed by covering and protecting a stacked load on a placement table so that the load does not collapse or break.

In addition, JP4186104B (Claim 1 and FIGS. 1 and 2) describes that the sheet for preventing load collapse is formed of a sixteen square shape top surface portion in which a plurality of tape portions are provided at the center of the top surface portion, four side surface pressing portions that are substantially triangular in shape and are connected to both end portions of the top surface portion and have a space shape at the center of an upper surface, a belt portion seamed to a distal end of the side surface pressing portion and attached with a buckle for adjusting a length, and a locking hook that is fixed to a distal end of the belt portion.

JP2006-131235A (Claim 1 and FIGS. 1 to 6) describes a load collapse prevention tool.

In addition, JP2006-131235A (Claim 1 and FIGS. 1 to 6) describes that the load collapse prevention tool is formed by dividing a load collapse prevention sheet for preventing load collapse by being wound around a side surface of a load stacked on a pallet or a truck in a winding length direction into a plurality of pieces, holding a belt on the load collapse prevention sheet to be slidable, and providing a stopper that can be tightened on the belt.

JP7265245B (Claim 1 and FIGS. 1 to 3) describes a partition member or the like in a container.

In addition, JP7265245B (Claim 1 and FIGS. 1 to 3) describes that the partition member is a buffering member for packaging made of a corrugated cardboard, which is attached to an end portion of an article to be stored in a packaging case, and includes an article storage concave portion that is surrounded by a lower support portion, a side support portion, and a rear end support portion and is open upward and inward.

SUMMARY

Aspects of non-limiting embodiments of the present disclosure relate to a corner protector that can be used by deforming a surface portion to be abutted on a corner of a loaded object.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a corner protector including: two surface portions having a rectangular shape and interposing a bent portion extending parallel to one side; a notch reaching the bent portion from one side of at least one surface portion of the two surface portions; and a folding line reaching one side of the other surface portion from a terminal end of the notch.

BRIEF DESCRIPTION OF THE DRAWINGS

Exemplary embodiment(s) of the present invention will be described in detail based on the following figures, wherein.

Figure 11A:
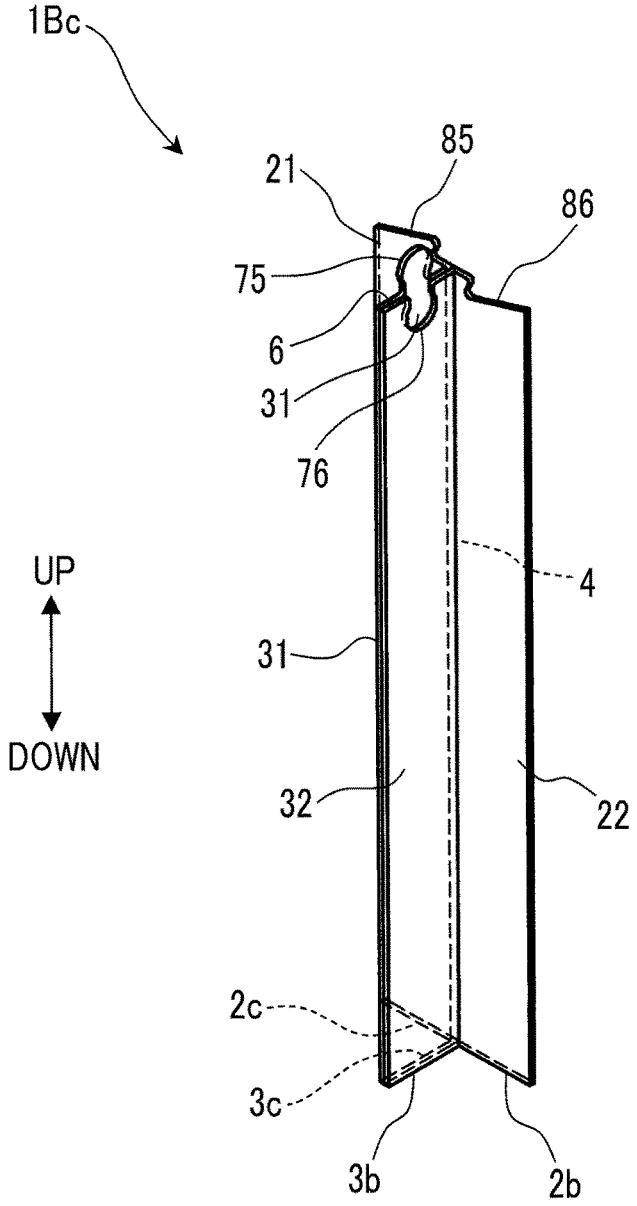
FIG. 11A is a perspective view showing a second deformed form of the corner protector of FIG. 6.
Figure 11B:
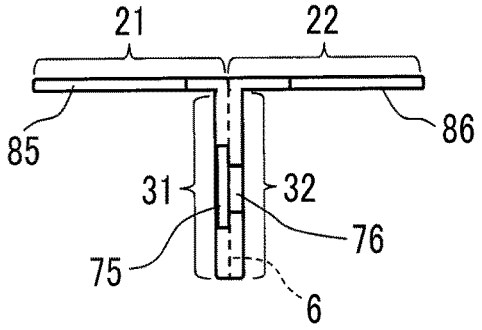
FIG. 11B is a top view of the form of FIG. 11A.
Figure 13:
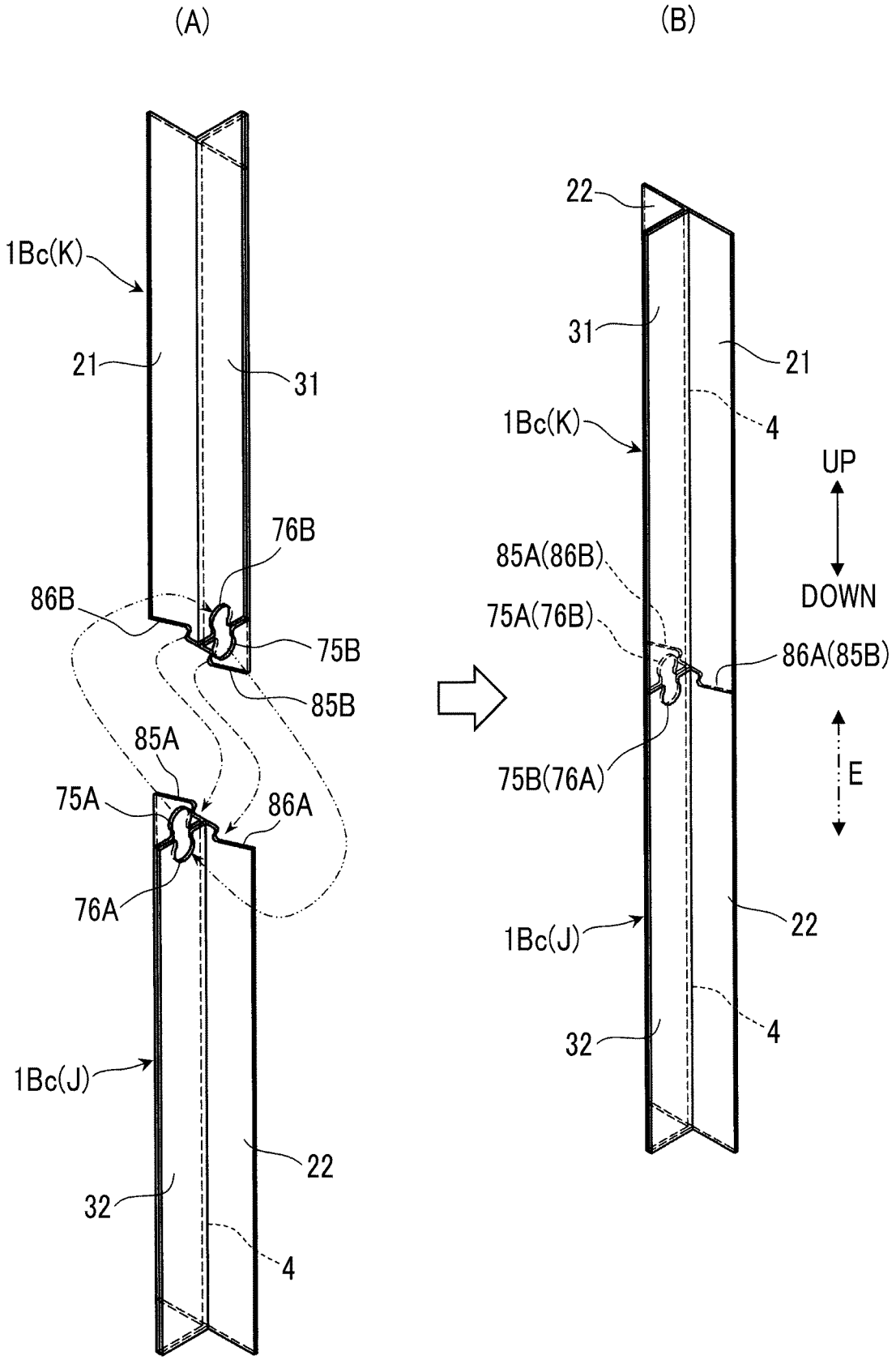
Figure 14:
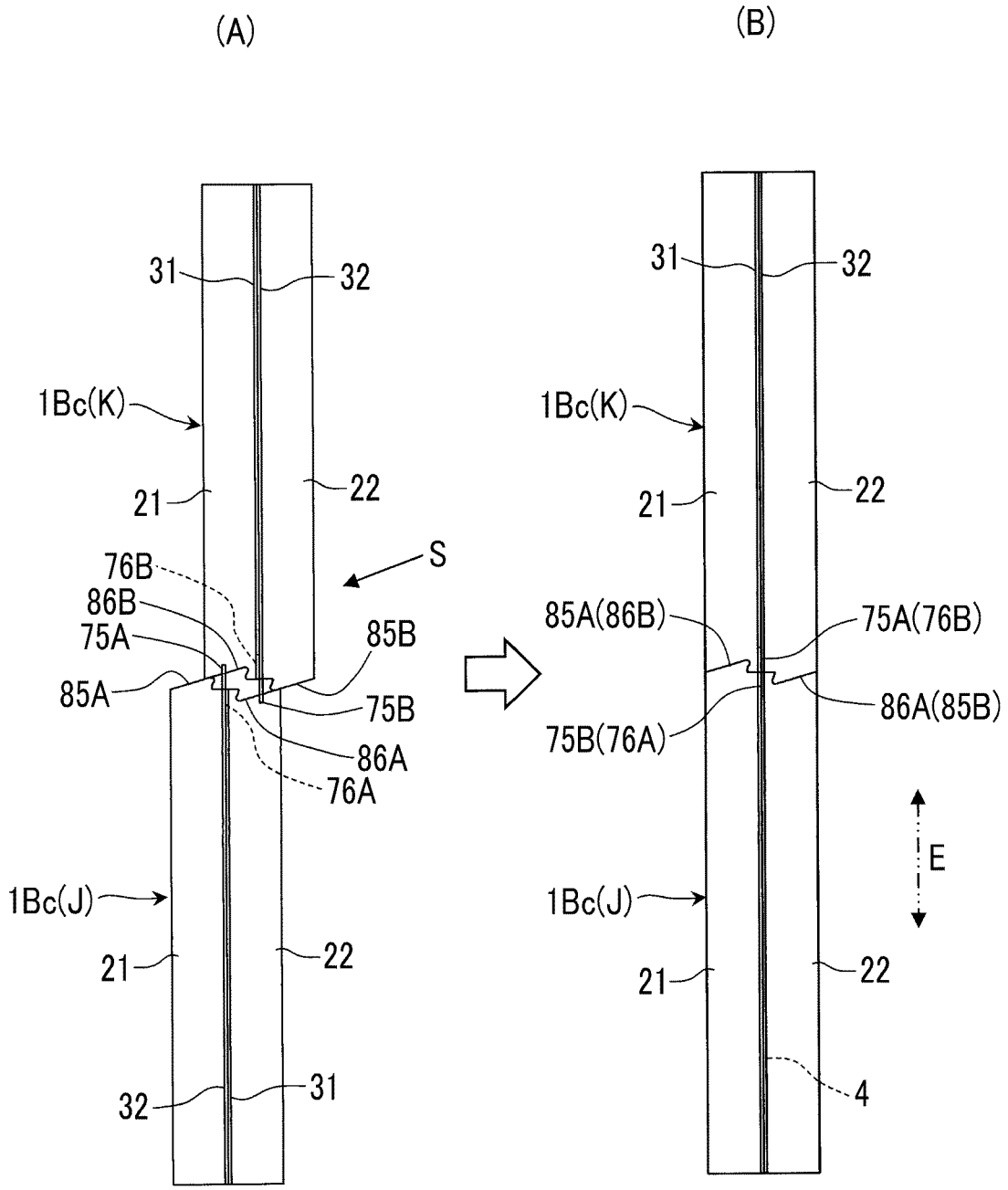
Figure 15:
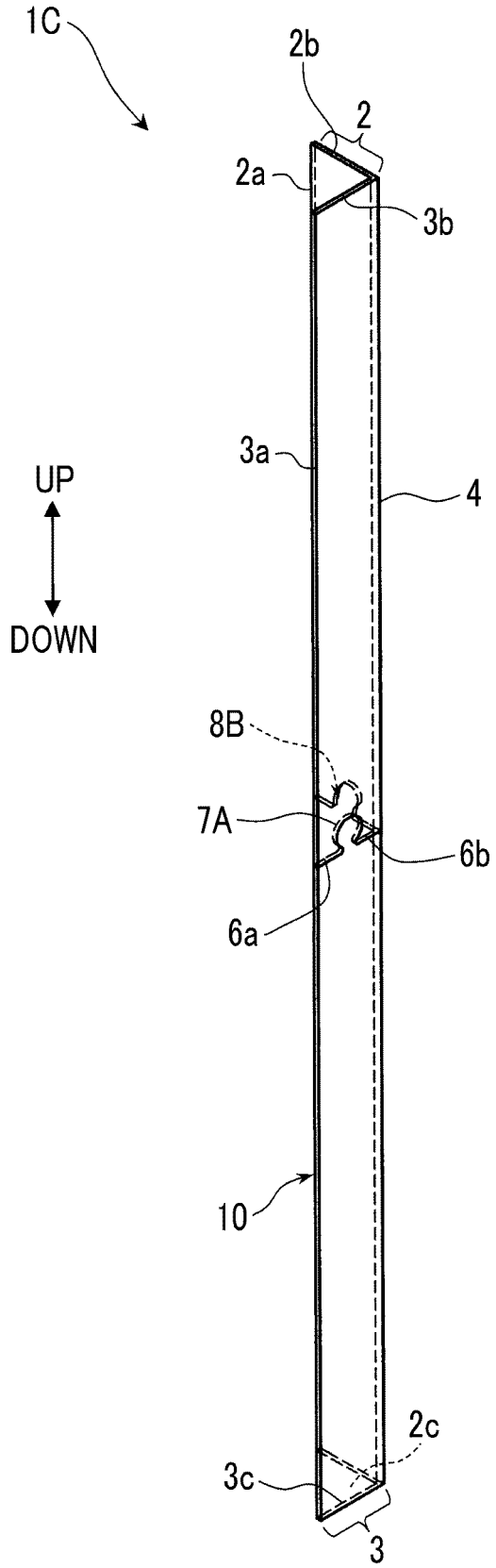
Figure 16:
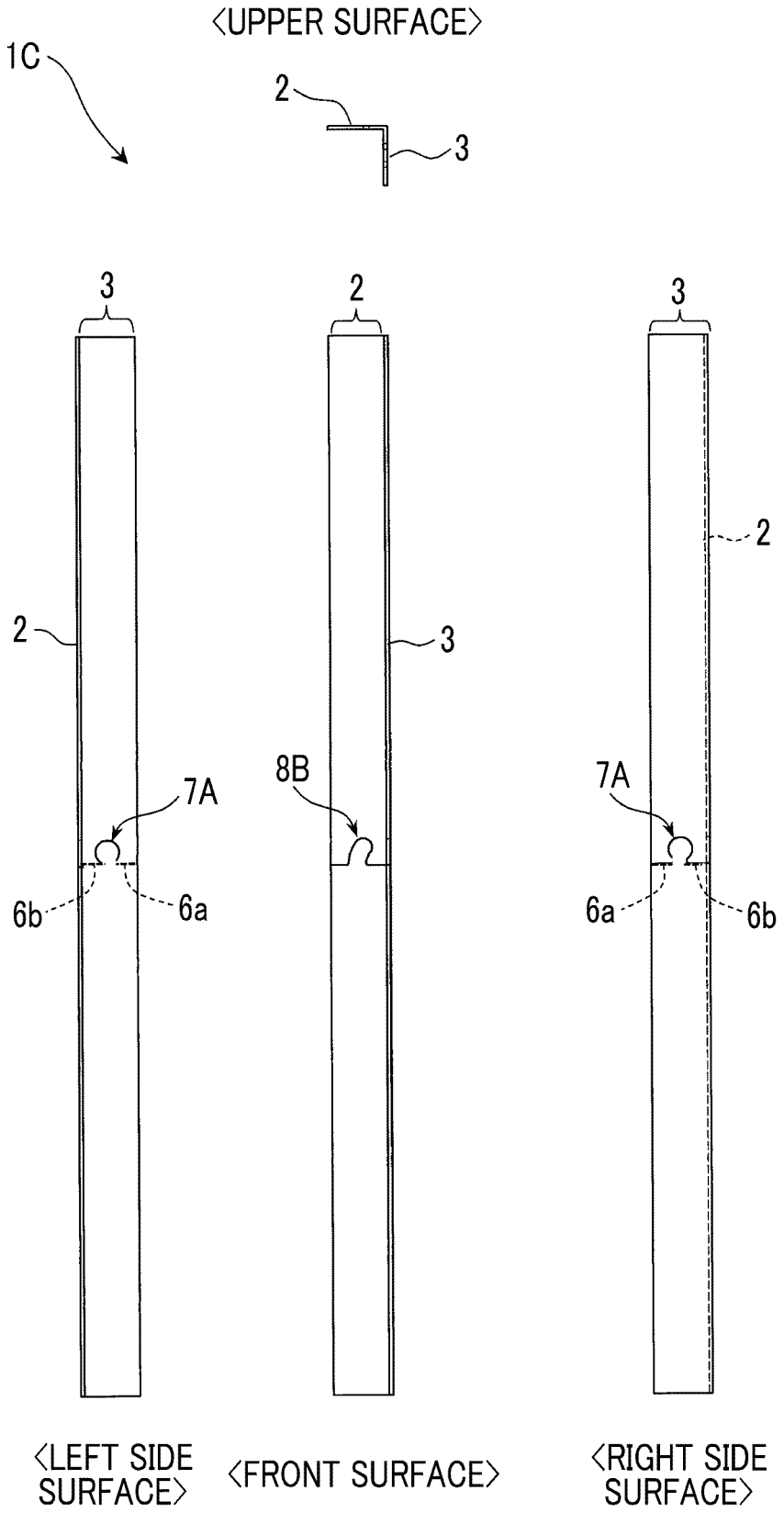
Figure 17:
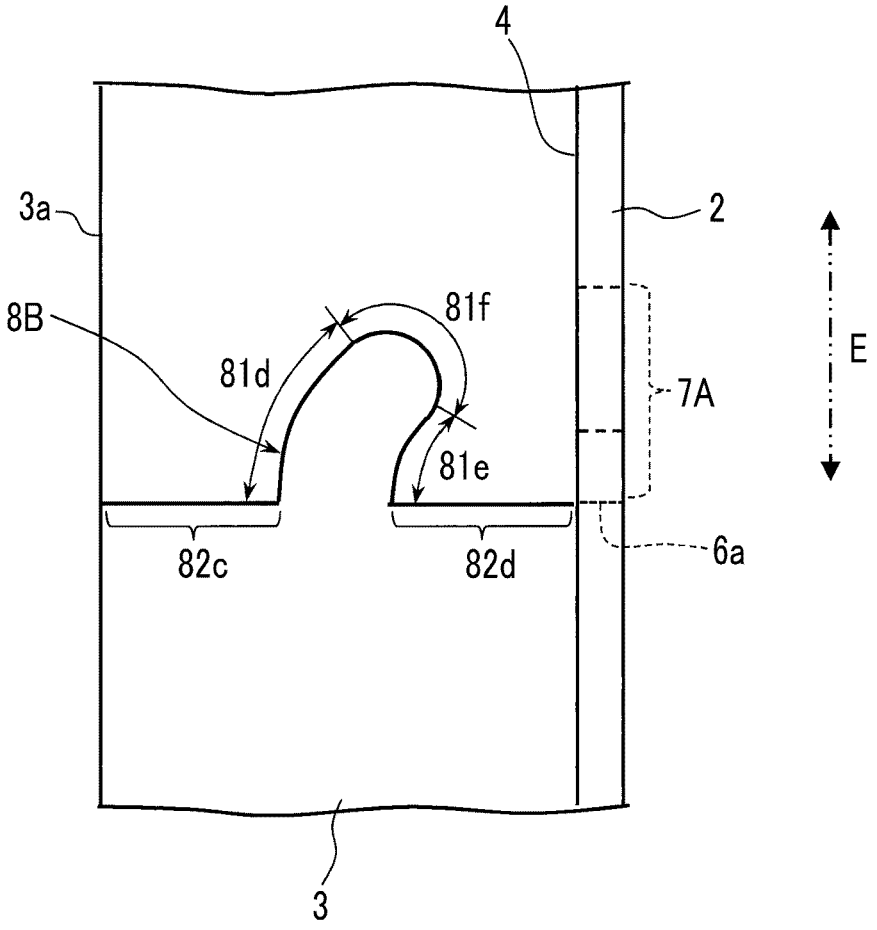
Figure 18A:
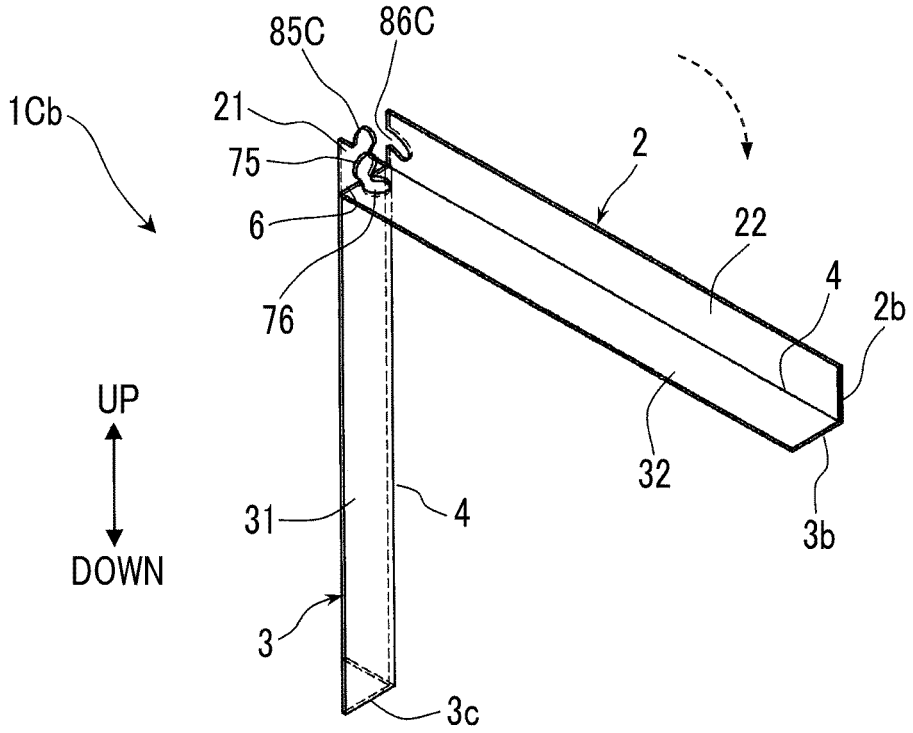
Figure 18B:
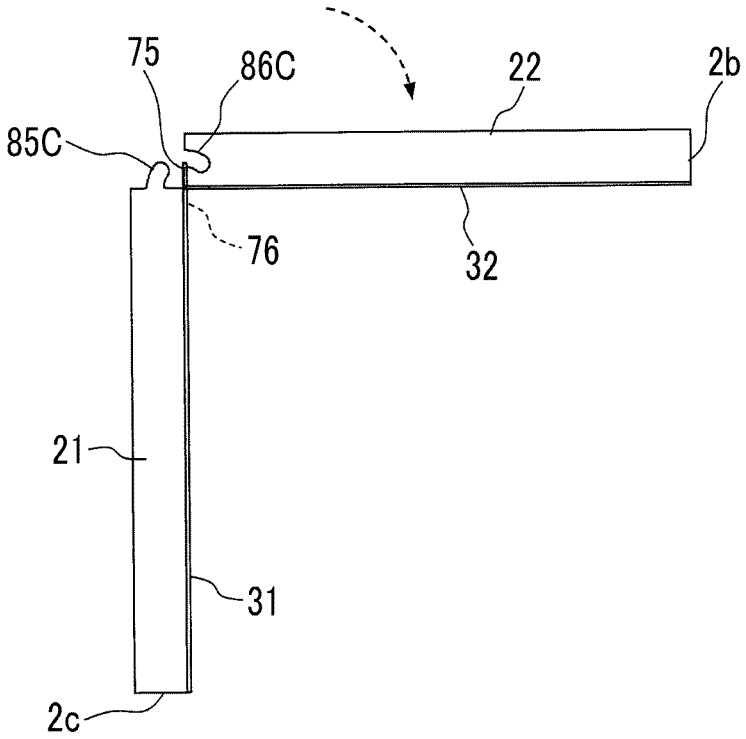
Figure 19:
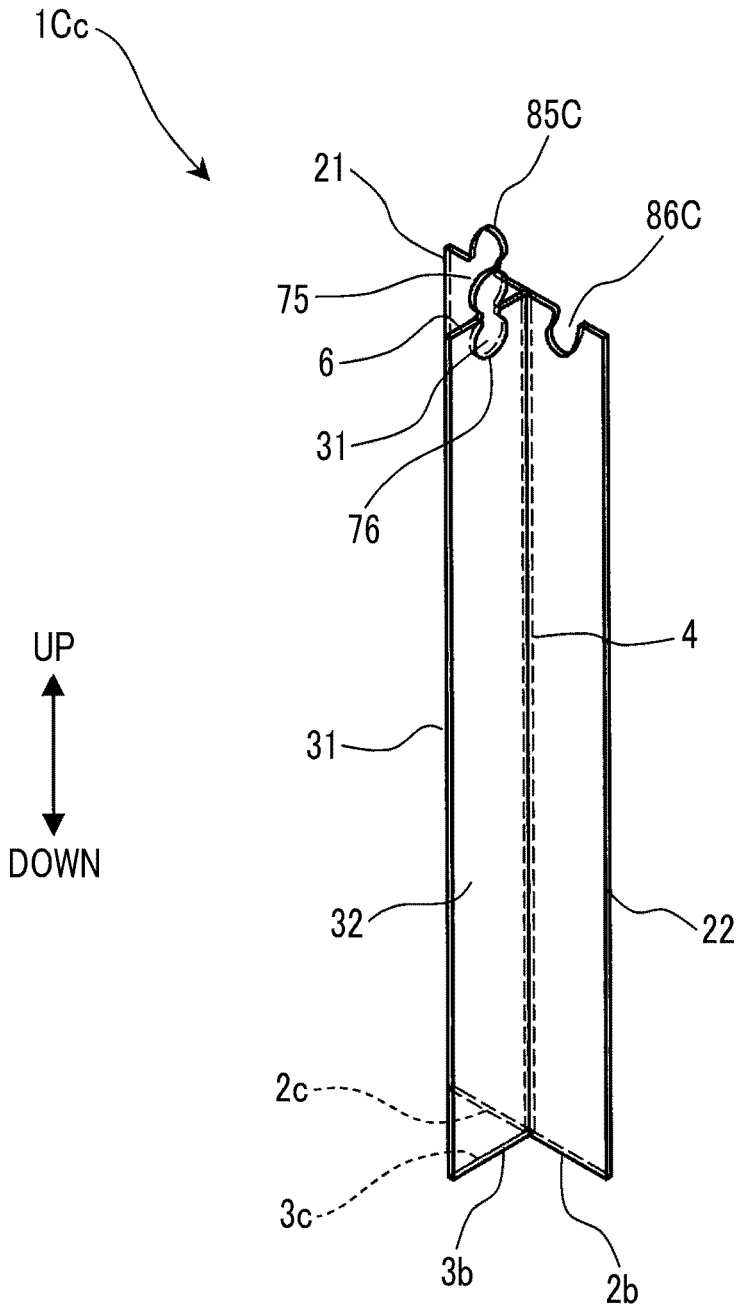
Figure 20:
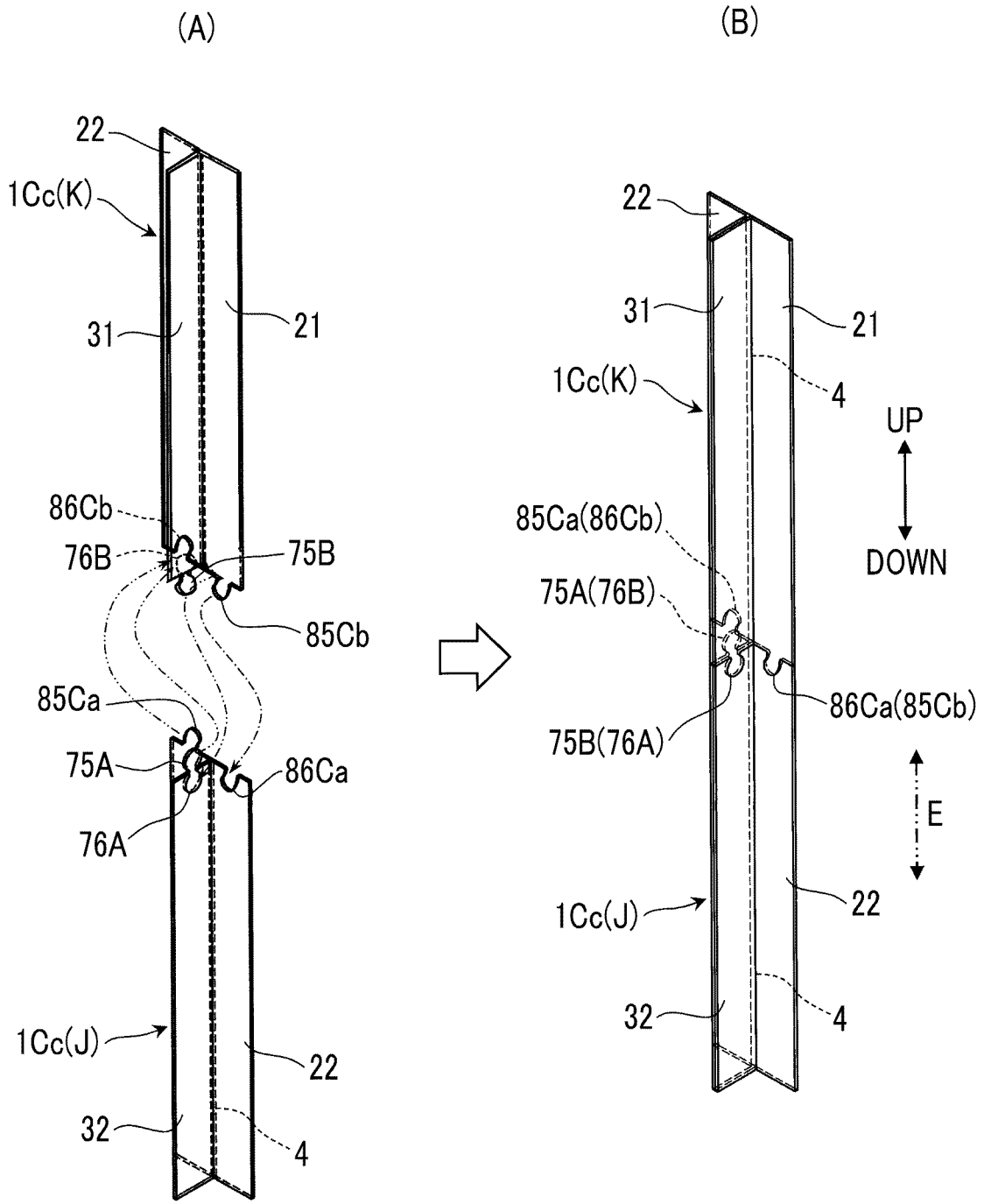
Figure 21:
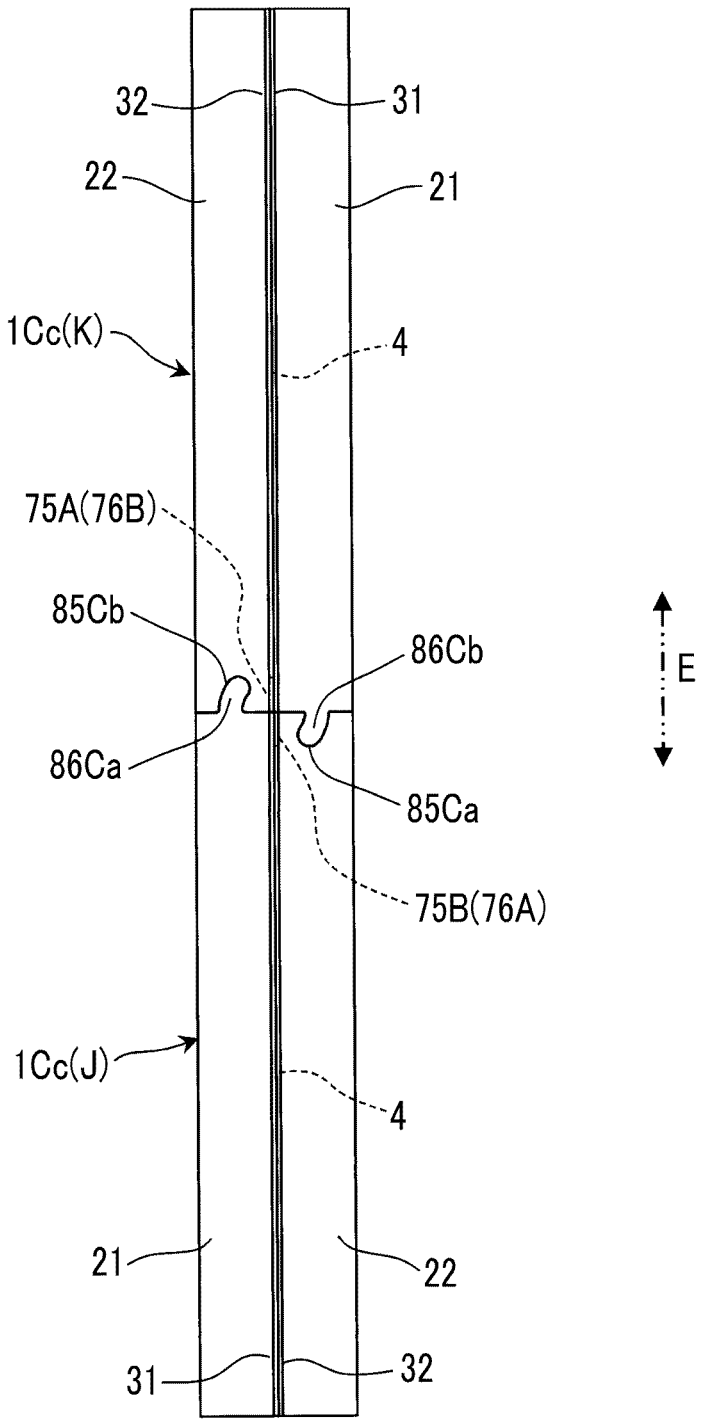
Figure 22:
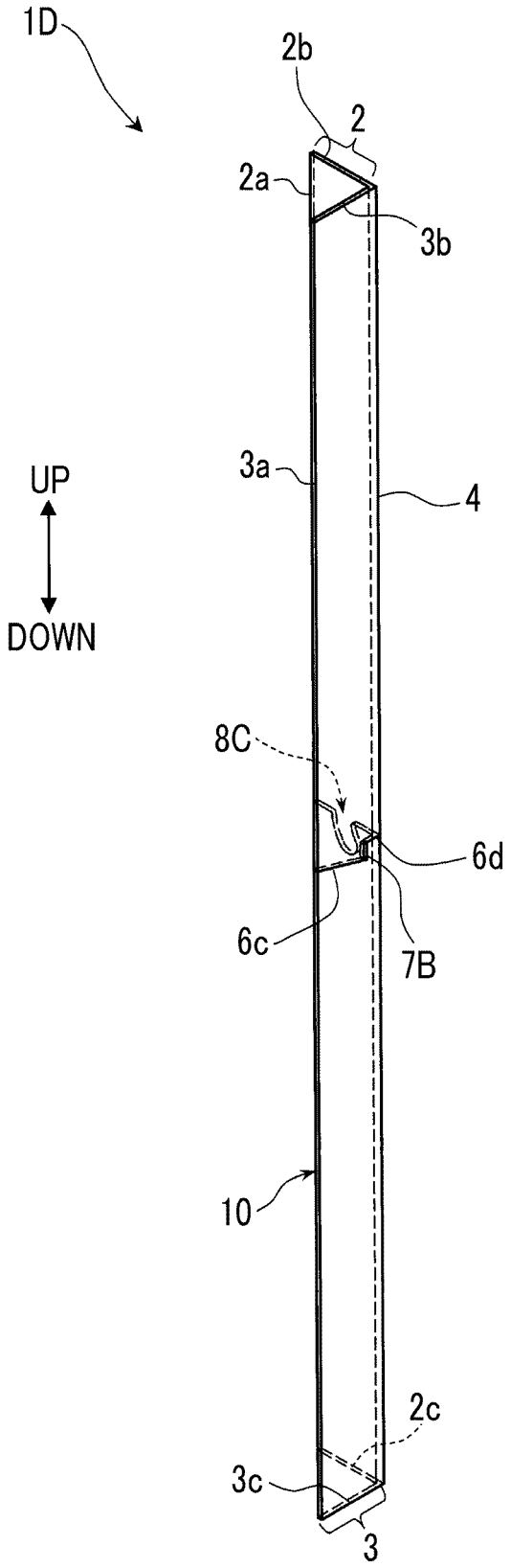
Figure 23:
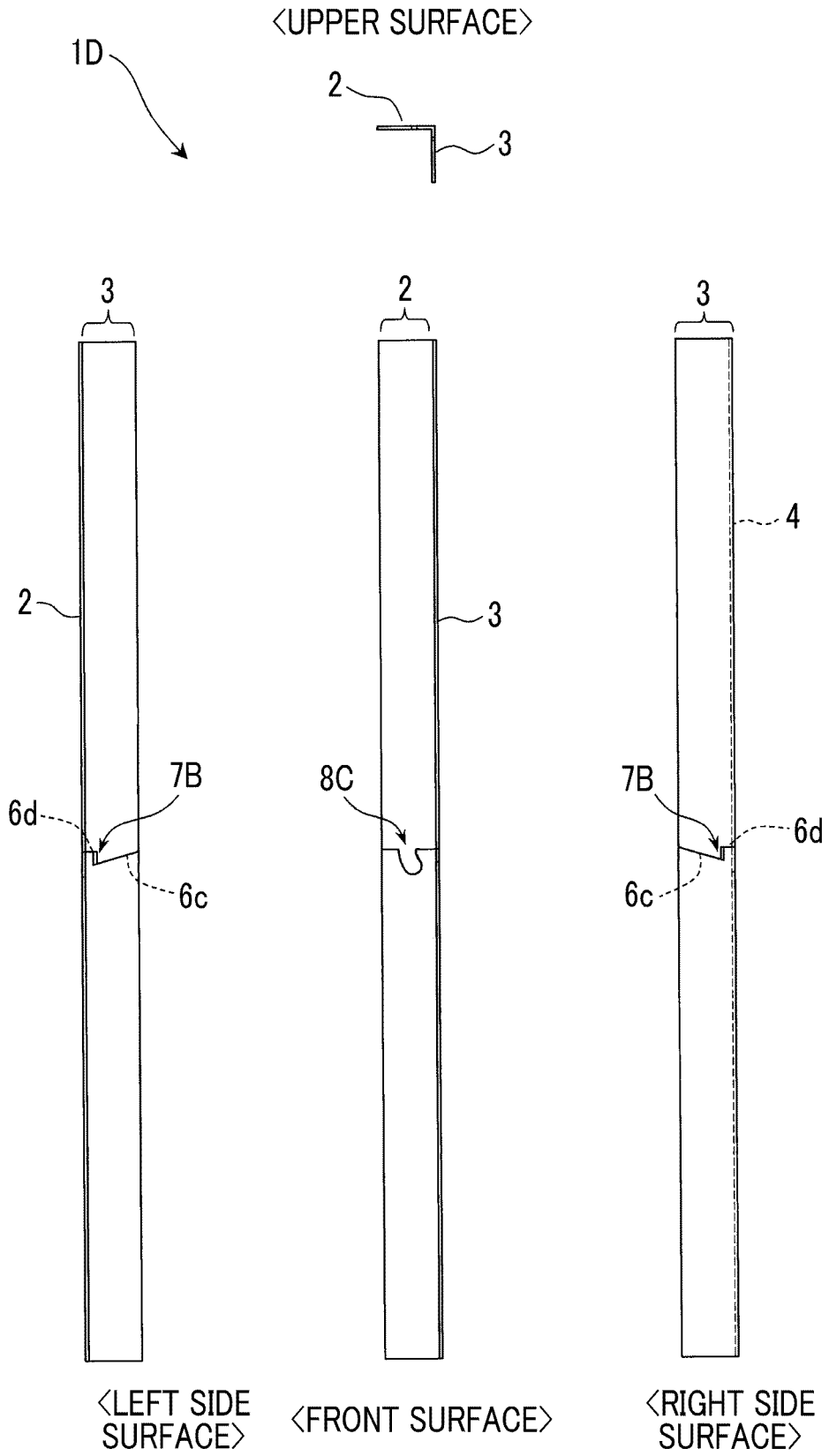
Figure 24A:
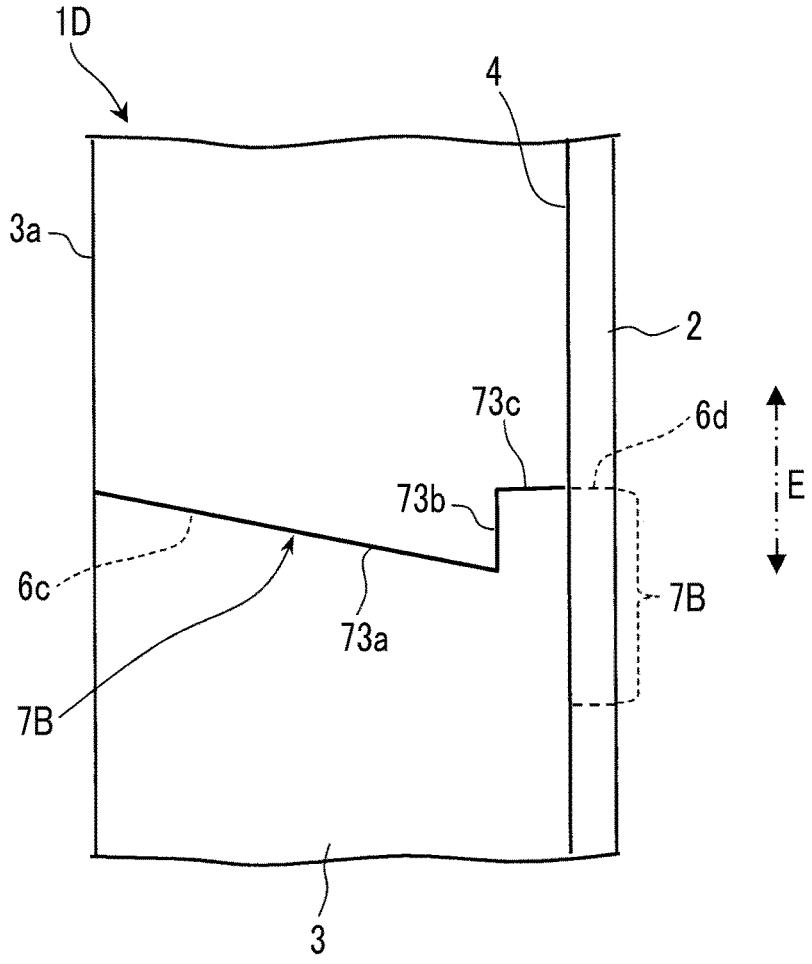
Figure 24B:
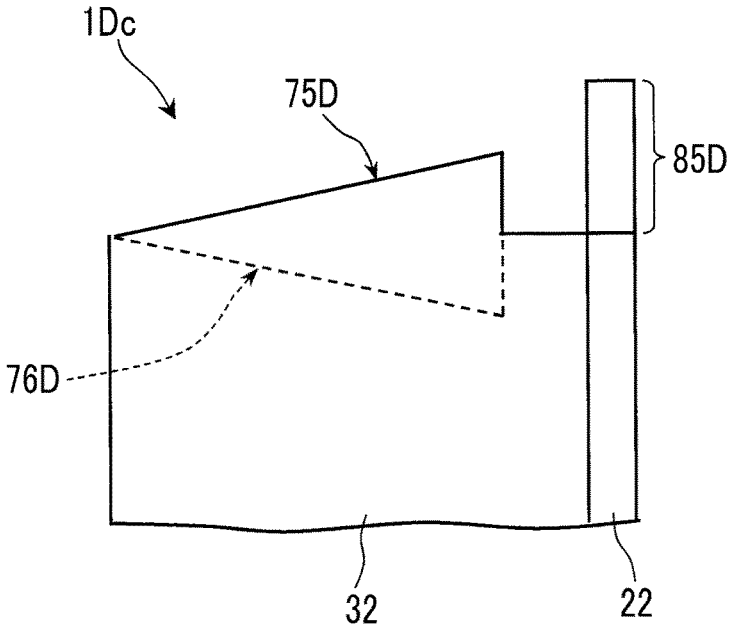
Figure 25:
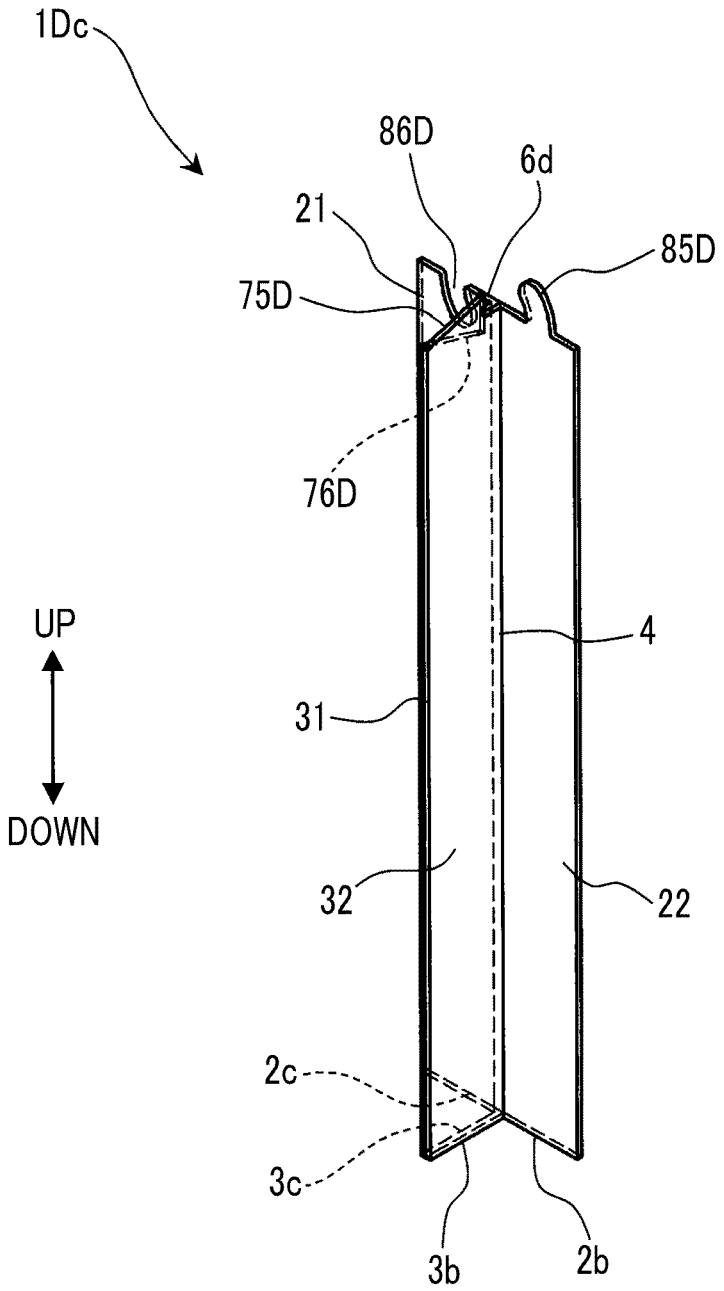
Figure 26:
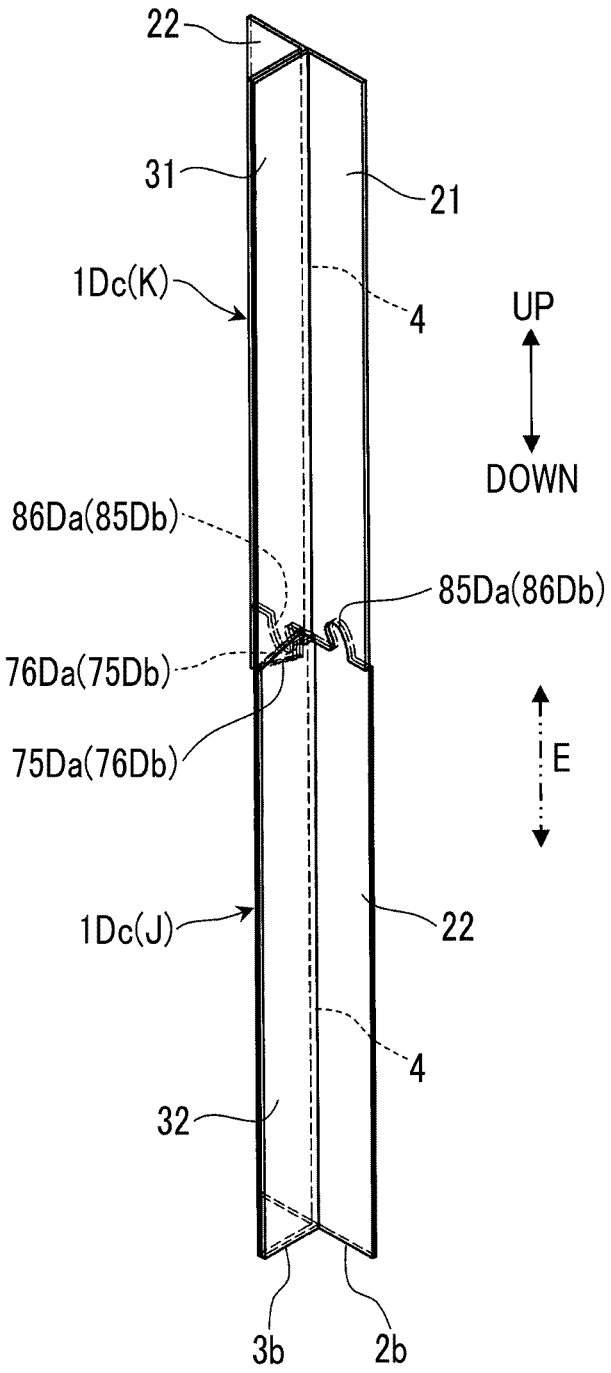
Figure 27:
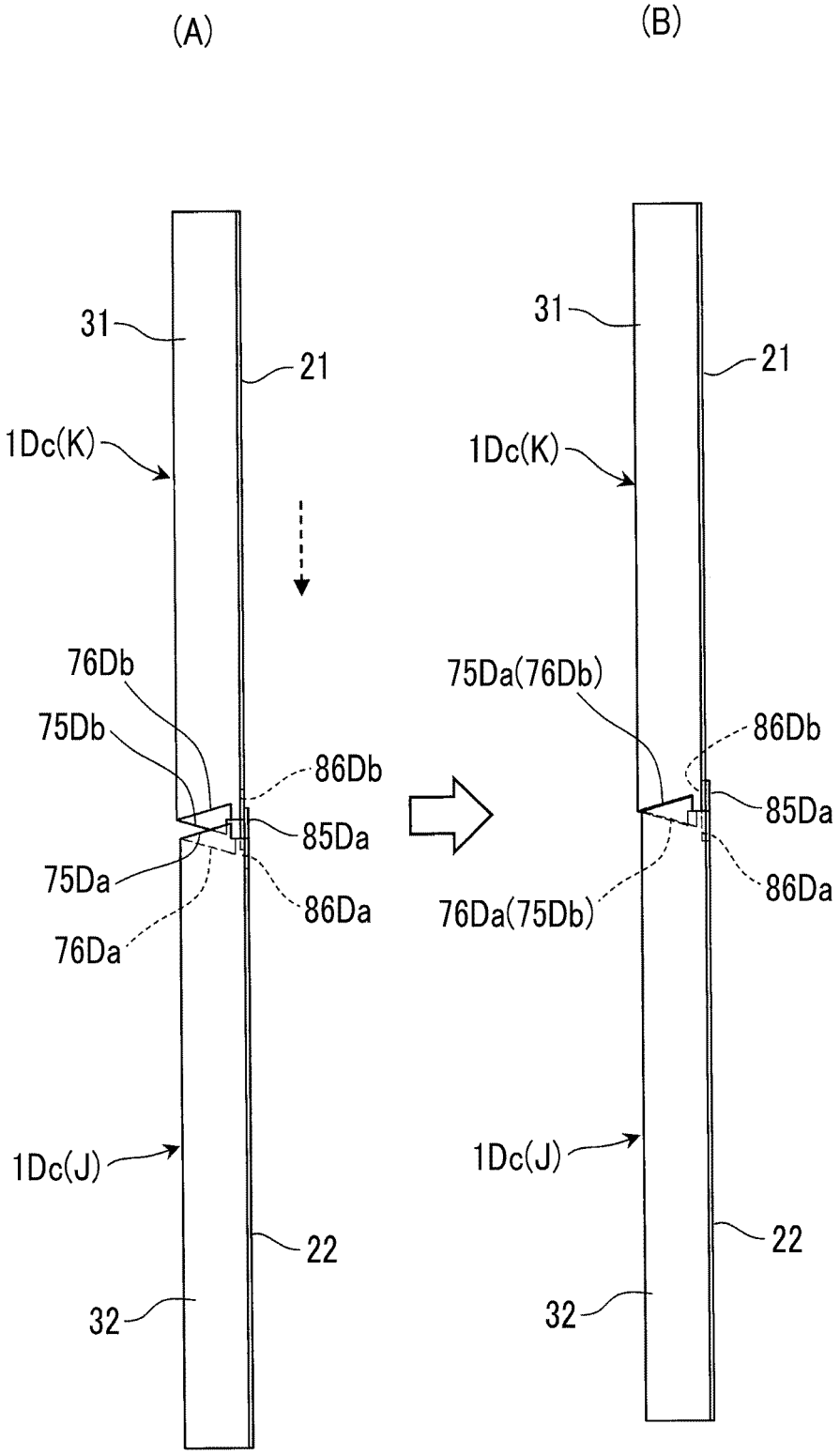
Figure 28A:
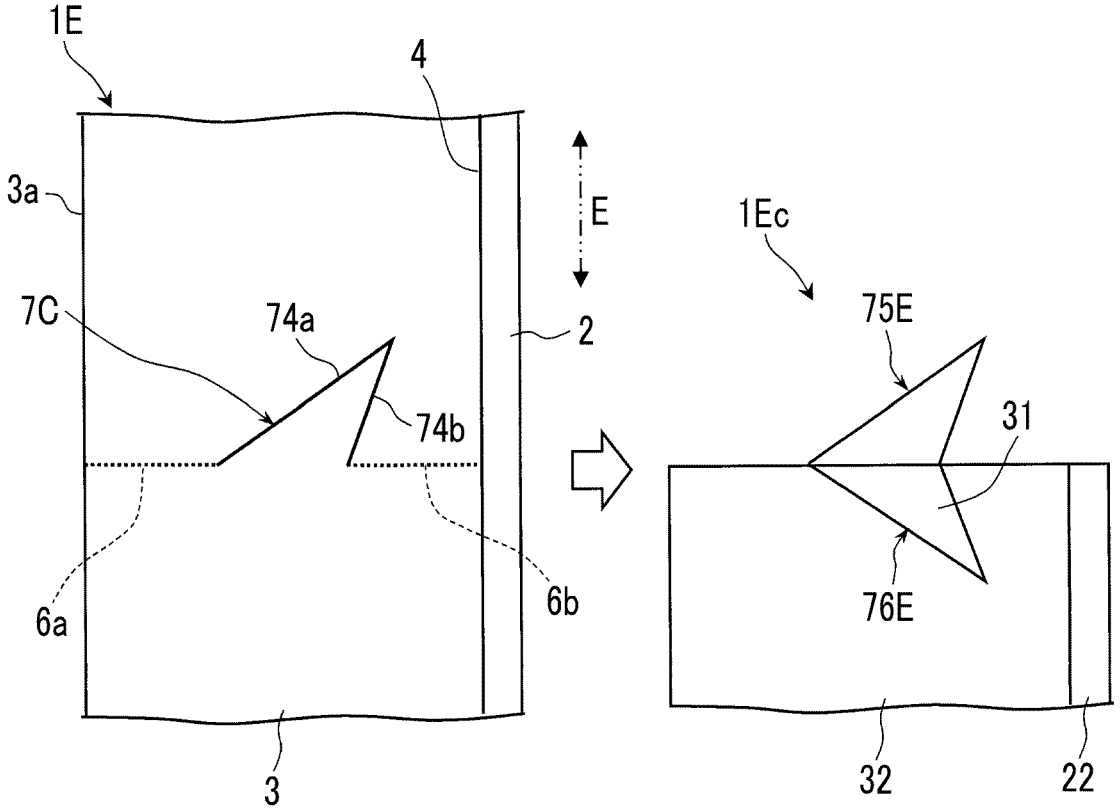
Figure 28B:
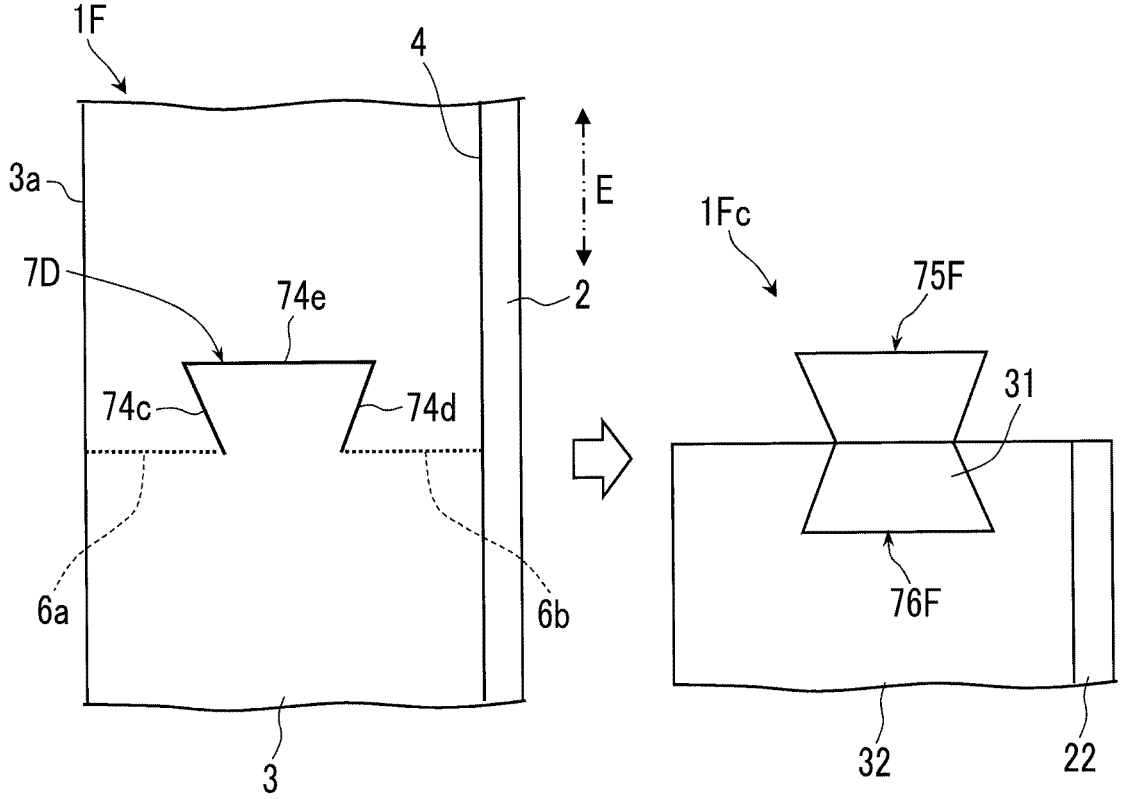
Figure 29:
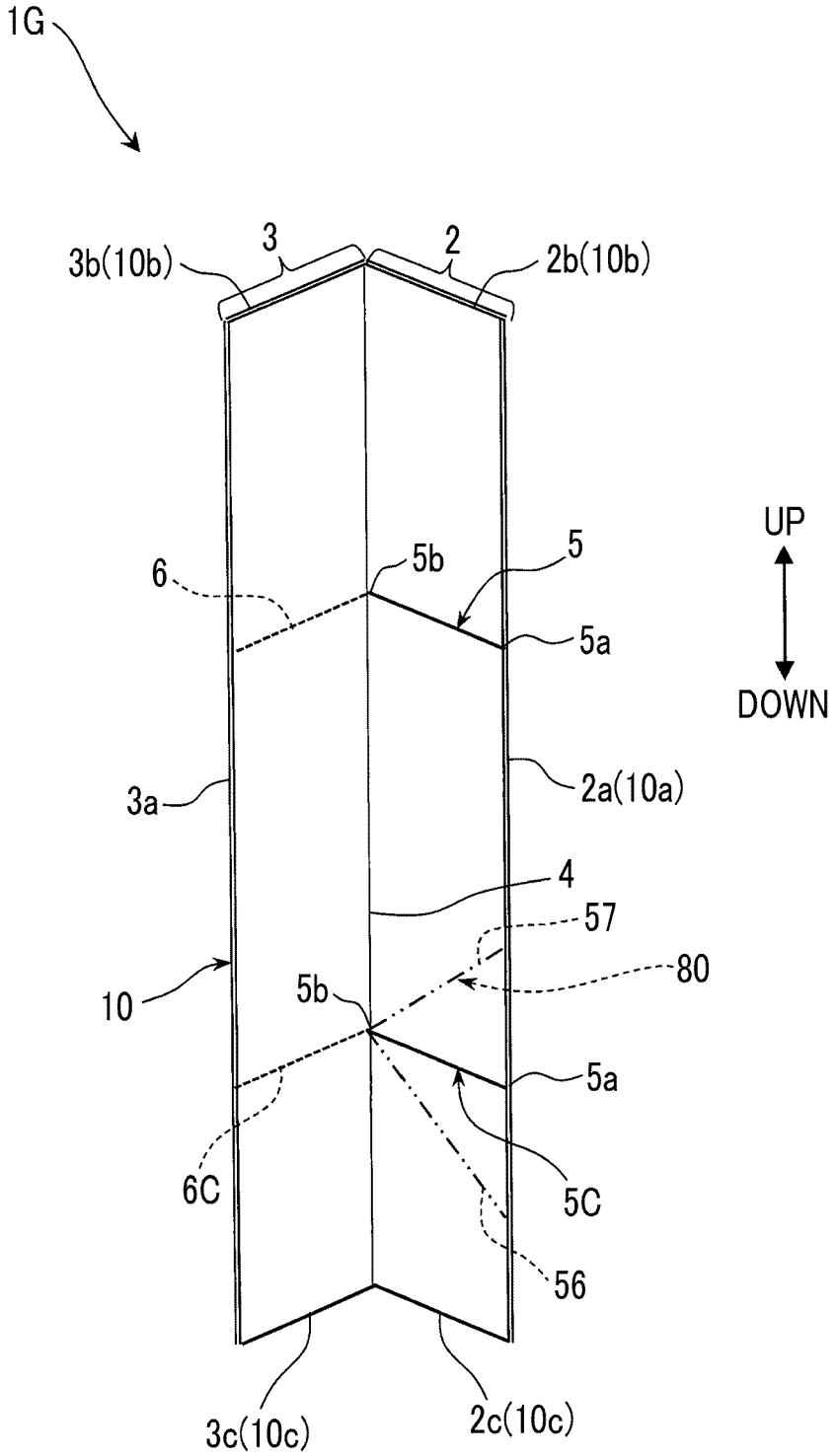
Figure 30:
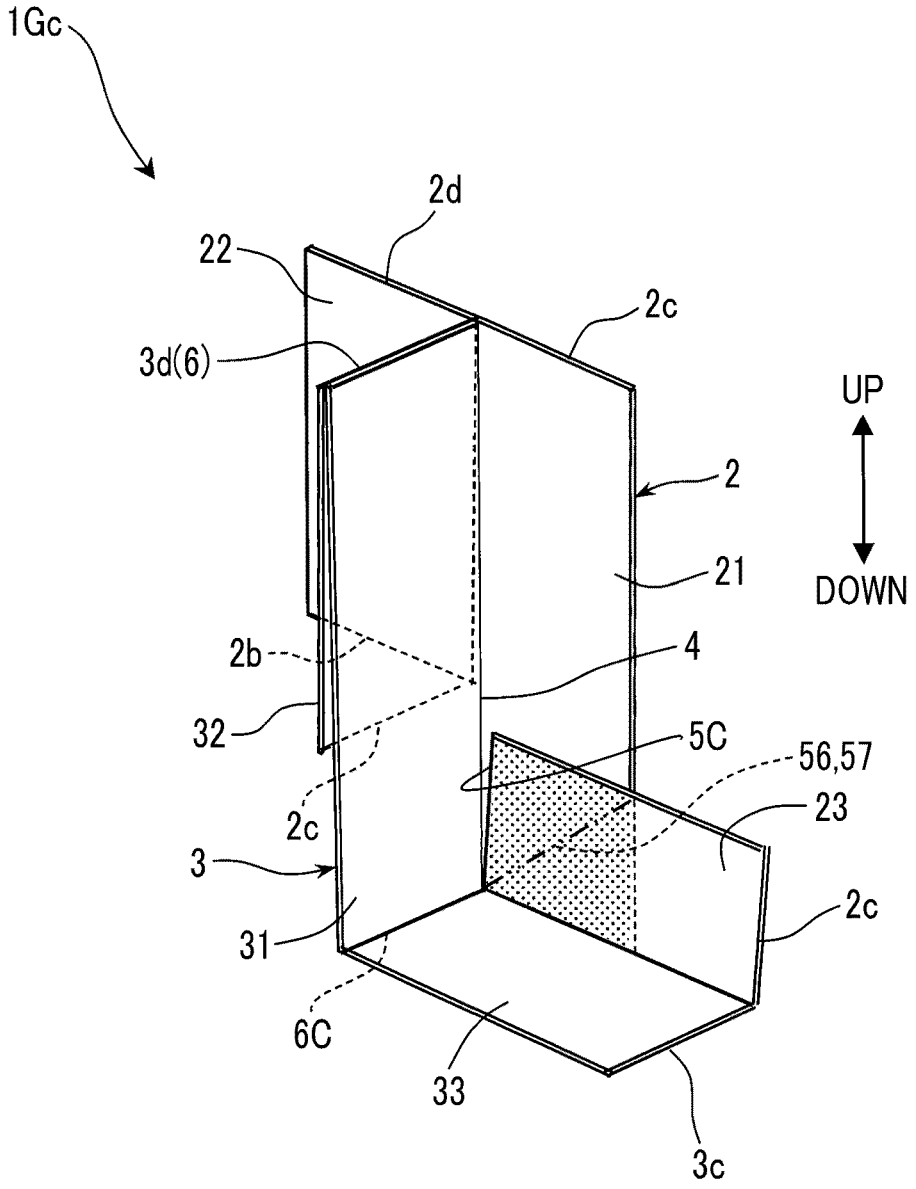
Figure 31A:
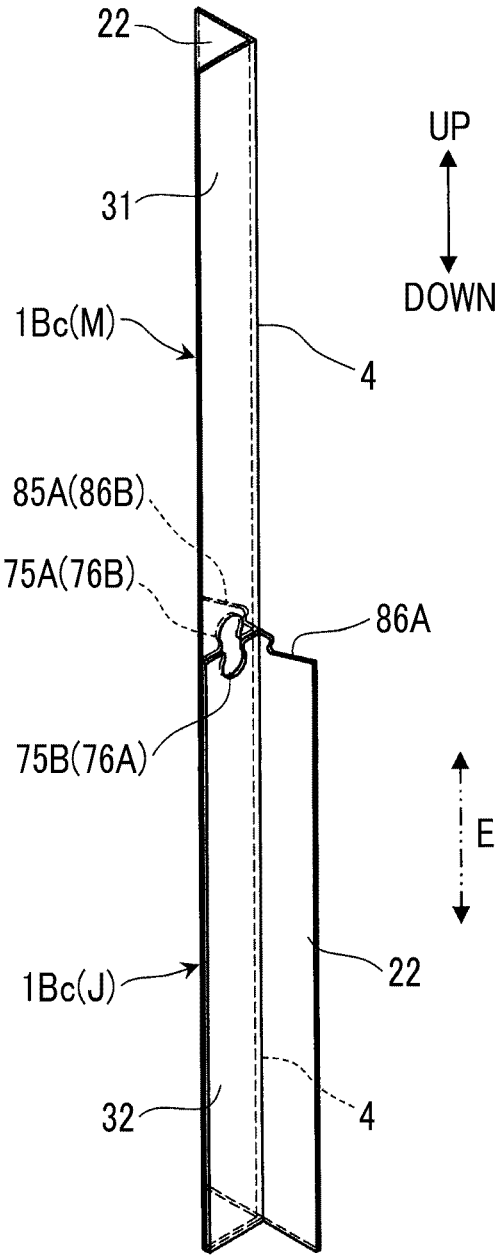
Figure 31B:
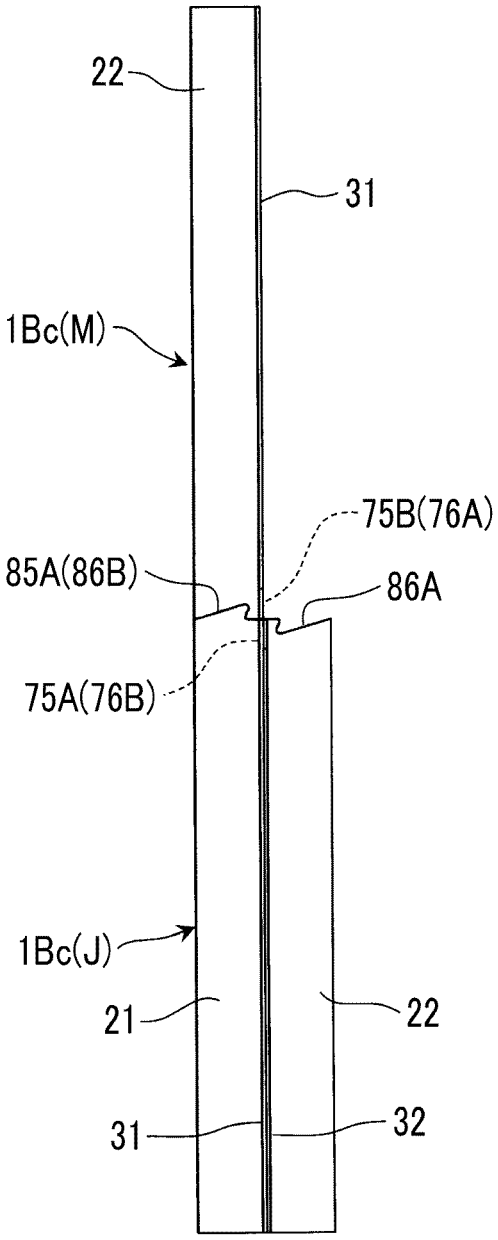
Figure 32:
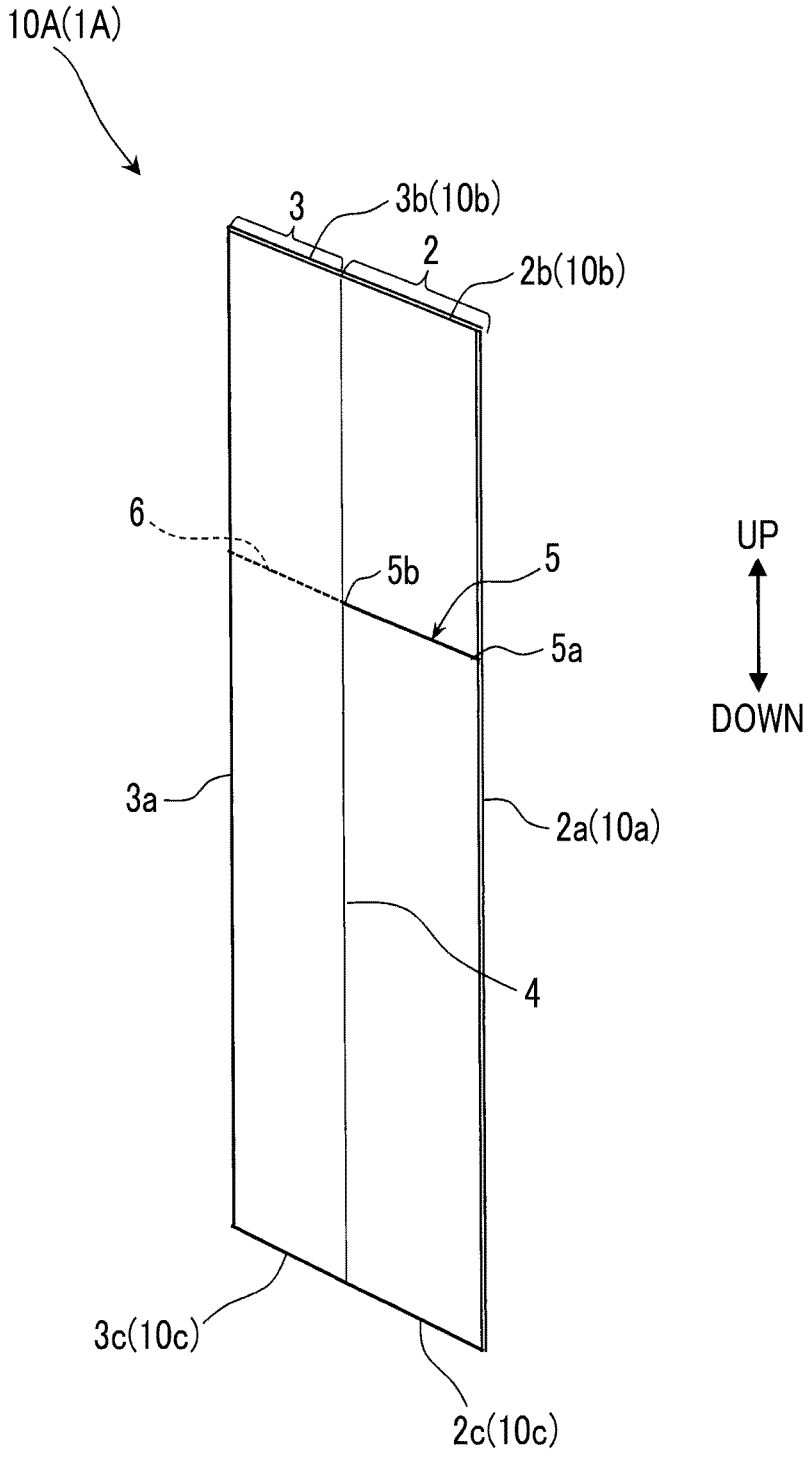
Figure 33A:
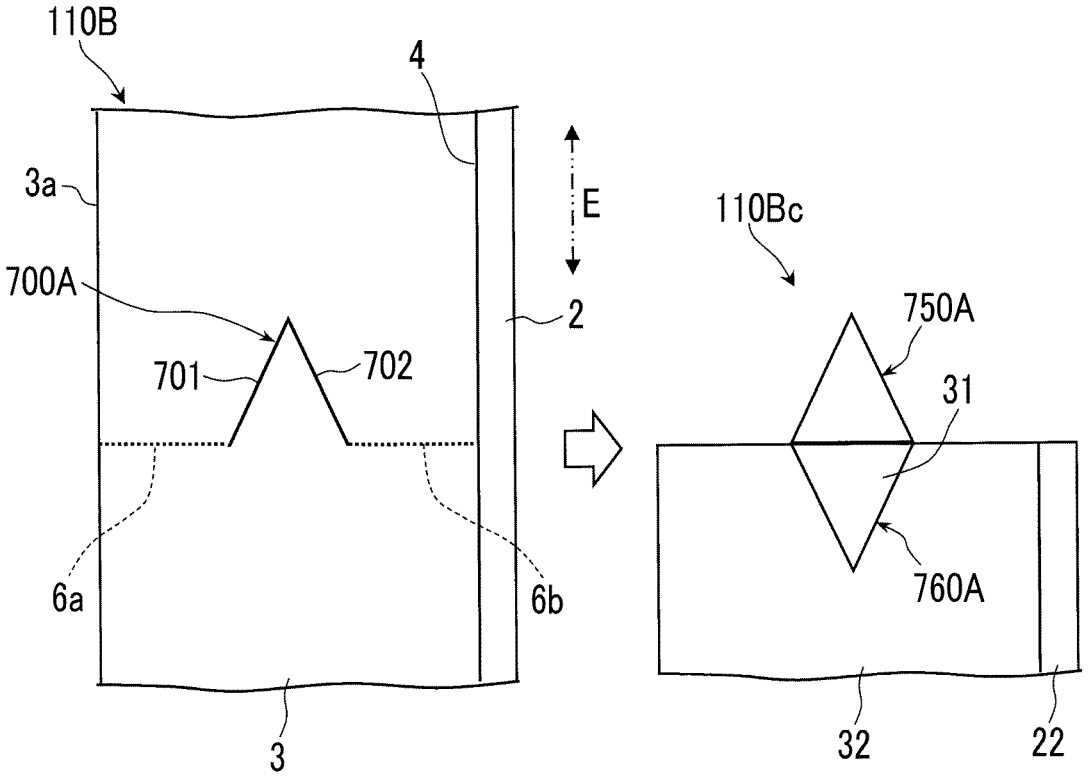
Figure 33B:
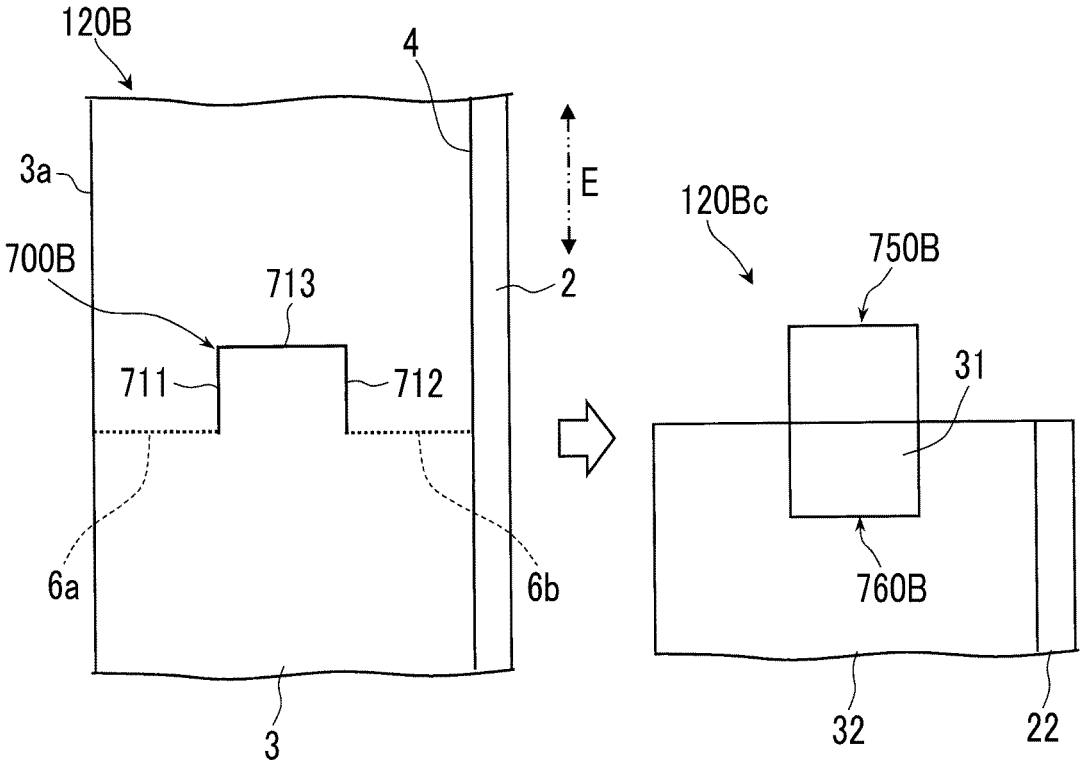

A part (A) in FIG. 13 is a perspective view showing a state before the corner protectors of the second deformed form of FIGS. 11A and 11B are connected to each other, and a part (B) in FIG. 13 is a perspective view showing a state in which the corner protectors of the part (A) are connected to each other;

A part (A) in FIG. 14 is a front view showing a part of work of connecting the corner protectors of the second deformed form of FIGS. 11A and 11B to each other, and a part (B) in FIG. 14 is a front view showing a state in which the corner protectors of the part (A) are connected to each other;

FIG. 15 is a perspective view of a corner protector according to Exemplary Embodiment 3;

FIG. 16 is a four-sided view of the corner protector of FIG. 15;

FIG. 17 is a schematic view showing a configuration of a third notch of the corner protector of FIG. 15;

FIG. 18A is a perspective view showing a first deformed form of the corner protector of FIG. 15, and FIG. 18B is a front view of the form of FIG. 18A;

FIG. 19 is a perspective view showing a second deformed form of the corner protector of FIG. 15;

A part (A) in FIG. 20 is a perspective view showing a state before the corner protectors of the second deformed form of FIG. 15 are connected to each other, and a part (B) in FIG. 20 is a perspective view showing a state in which the corner protectors of the part (A) are connected to each other;

FIG. 21 is a front view showing a state in which the corner protectors of FIG. 15 are connected to each other;

FIG. 22 is a perspective view of a corner protector according to Exemplary Embodiment 4;

FIG. 23 is a four-sided view of the corner protector of FIG. 22;

FIG. 24A is a schematic view showing a configuration of a second notch of the corner protector in FIG. 22, and FIG. 24B is a schematic view showing a state of a protruding portion, a recess portion, and the like that appear in a folded end portion of the corner protector of FIG. 24A;

FIG. 25 is a perspective view showing a second deformed form of the corner protector of FIG. 22;

FIG. 26 is a perspective view showing a state in which the corner protectors of FIG. 22 are connected to each other;

A part (A) in FIG. 27 is a perspective view showing a state before the corner protectors of the second deformed form of FIG. 22 are connected to each other, and a part (B) in FIG. 27 is a perspective view showing a state in which the corner protectors of the part (A) are connected to each other;

FIG. 28A is a schematic view showing a configuration of a second notch of a corner protector according to Modification Example 1, and FIG. 28B is a schematic view showing a configuration of a second notch of a corner protector according to Modification Example 2;

FIG. 29 is a perspective view of a corner protector according to Modification Example 3;

FIG. 30 is a perspective view showing a third deformed form of the corner protector of FIG. 29;

FIG. 31A is a perspective view showing a state in which corner protectors according to Modification Example 6 are connected to each other, and FIG. 31B is a front view showing the state of FIG. 31A;

FIG. 32 is a perspective view of a corner protector of Modification Example 7; and FIG. 33A is a schematic view showing a configuration of a major part of a corner protector as a comparison target, and FIG. 33B is a schematic view showing a configuration of a major part of a corner protector as another comparison target.

DETAILED DESCRIPTION

Hereinafter, exemplary embodiments of the present invention will be described in detail with reference to the accompanying drawings.

Exemplary Embodiment 1

Figure 1:
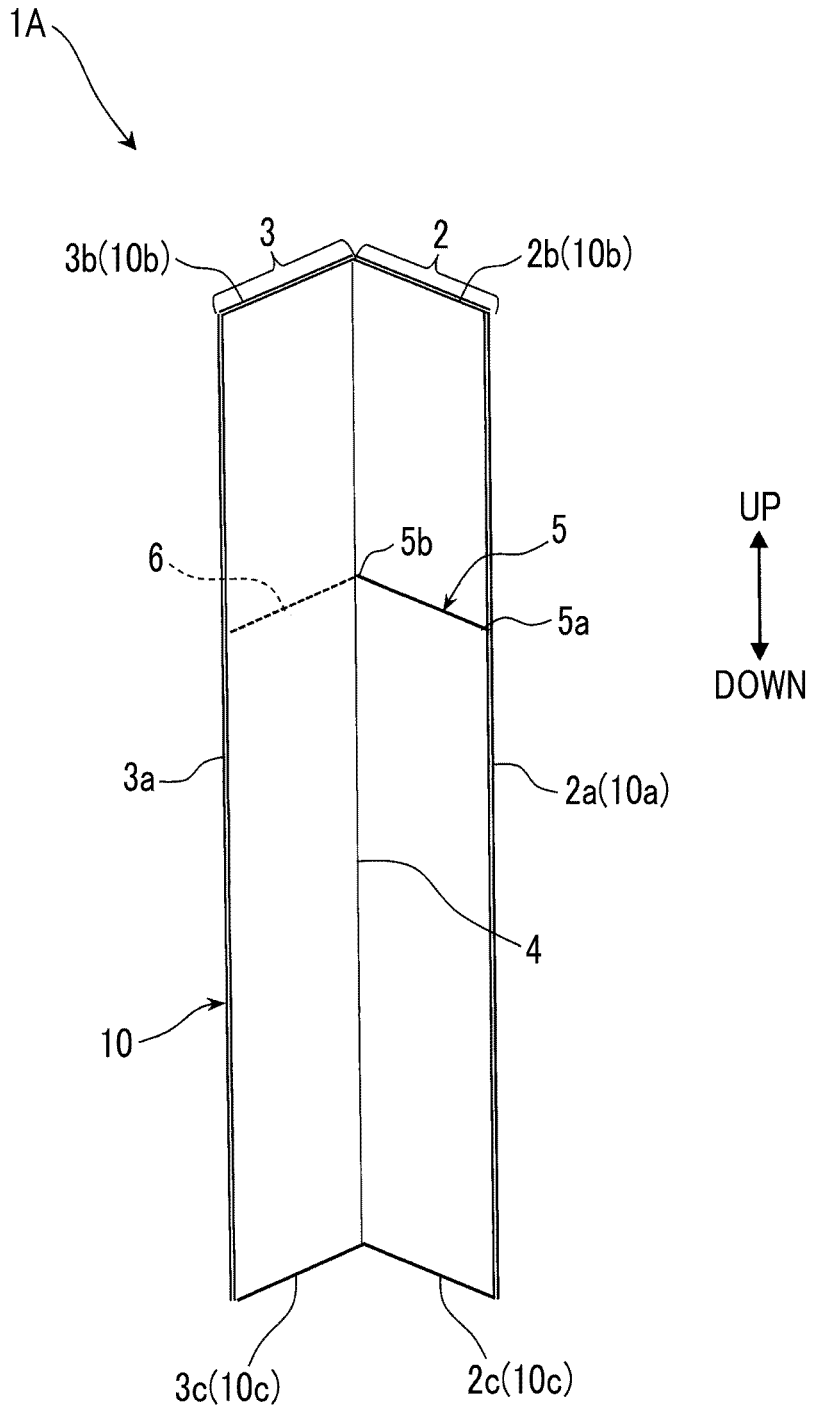
FIG. 1 is a perspective view of a corner protector according to Exemplary Embodiment 1.

FIG. 1 is a perspective view of a corner protector 1A according to Exemplary Embodiment 1 of the present invention.

In the present specification and the drawings, the identical component is denoted by substantially the identical reference numeral. Further, in the present specification, the duplicate description of the identical component is omitted.

Overview of Corner Protector 1A

As shown in FIG. 1, the corner protector 1A is a member including two surface portions 2 and 3 having a rectangular shape and interposing a bent portion 4, a notch 5, and a folding line 6.

The corner protector 1A is formed of one sheet of a surface material 10 that is foldable.

Figure 4A:
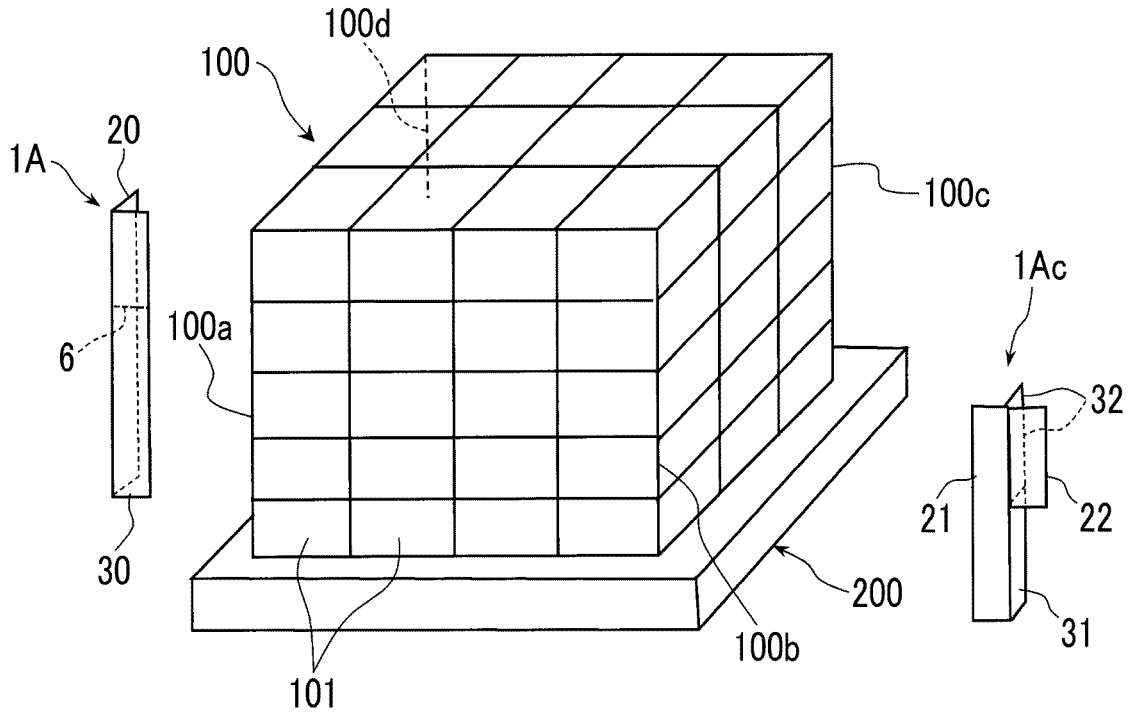
FIG. 4A is a schematic perspective view showing a loaded object and a part of the corner protector.
Figure 4B:
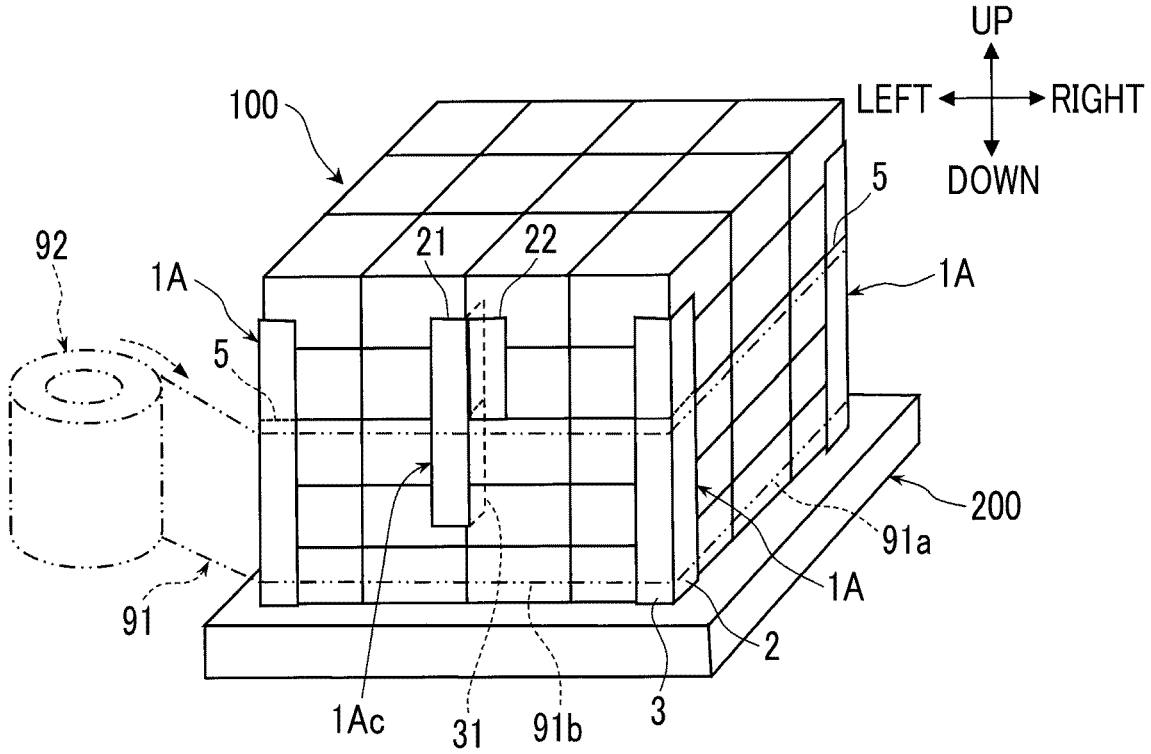
FIG. 4B is a schematic perspective view showing an example in which a part of the corner protector is used for the loaded object of FIG. 4A.

As shown in FIGS. 4A and 4B, the corner protector 1A is used as a member for suppressing the occurrence of the load collapse by being abutted on a necessary corner of a loaded object 100 in which the identical type of loads 101 are stacked on a pallet 200 in a plurality of stages in a case in which the corner protector 1A is transported as the loaded object 100.

In this case, the corner protector 1A can be used in a state in which the two surface portions 2 and 3 are not folded, and can also be used in a state in which the two surface portions 2 and 3 are folded, as will be described below. The load 101 is an article in which a product or the like is packaged in a box having the identical size. The load 101 may also be an article having substantially the identical outer appearance shape with the corners and being capable of being loaded.

In addition, in a case in which the transport is performed using the corner protector 1A, as shown in FIGS. 4A and 4B, a packaging film 91 is wound around a necessary outer surface of the loaded object 100, such as a side surface, including the corner protector 1A.

Reference numeral 92 in FIG. 4B or the like indicates a packaging film roll obtained by winding the packaging film 91 around a roll core. In addition, reference numerals 91*a* and 91*b* indicate portions of the packaging film 91 wound around two side surfaces of the loaded object 100.

The two surface portions 2 and 3 are two surfaces divided by the bent portion 4 having a linear shape in which the surface material 10 having a rectangular shape extends parallel to one side. The rectangular shape is a rectangle shape or a square shape.

The bent portion 4 is a portion in which the surface material 10 is bent at a substantially right angle. In addition, the bent portion 4 may be formed by bending the surface material 10 in a case in which the corner protector 1A is used, as will be described below.

The bent portion 4 in Exemplary Embodiment 1 is a linear portion extending parallel to a lateral side 10*a* that is one of the long sides of the surface material 10 having a rectangle shape as shown in FIG. 1. In addition, the bent portion 4 is formed to extend, for example, from substantially the center of an upper side 10*b*, which is one of the short sides of the surface material 10 having a rectangle shape, toward the center of a lower side 10*c*, which is another short side.

As a result, both the surface portions 2 and 3 in Exemplary Embodiment 1 are surface portions having a rectangle shape long in an up-down direction as shown in FIG. 1.

In this case, the surface portion 2 has a lateral side 2*a* as a long side on the opposite side to the bent portion 4 and an upper side 2*b* and a lower side 2*c* as two short sides. In addition, the surface portion 3 also has a lateral side 3*a* as a long side on the opposite side to the bent portion 4, and an upper side 3*b* and a lower side 3*c* as two short sides.

A length of each side of the surface portions 2 and 3 is set to a predetermined length, and a thickness thereof is set to a predetermined dimension in accordance with the conditions such as the application.

The notch 5 is a portion that is notched to reach the bent portion 4 from one side of at least one surface portion of the two surface portions 2 and 3.

The notch 5 in Exemplary Embodiment 1 is provided as a notch extending linearly perpendicularly from the lateral side 2*a* of the surface portion 2, which is the one surface portion, to the bent portion 4. In addition, the notch 5 is started to be notched from a predetermined position of the lateral side 2*a* of the surface portion 2. Of course, the notch 5 may be provided in the surface portion 3, which is the other surface portion.

The notch 5 is a notch of a straight line, and can also be referred to as a first notch from the viewpoint of being distinguished from a second notch 7 or a fourth notch 9, which will be described below.

The folding line 6 is a line for facilitating the folding work, and is formed to reach one side of the surface portion 3, which is the other surface portion, from a terminal end 5*b* of the notch 5. Reference numeral 5*a* in FIG. 1 indicates a start end of the notch 5.

The folding line 6 in Exemplary Embodiment 1 is formed as a portion extending linearly to reach the lateral side 3*a* of the surface portion 3, which is the other surface portion, from the terminal end 5*b* of the notch 5.

The folding line 6 may be any line appropriate for a type or a folding degree of the surface material 10 of the corner protector 1A. As the folding line 6, for example, a line with a notch having a depth necessary on a surface on a side opposite to a folding direction or a perforated line may be applied.

By the way, in a case in which the surface material 10 is a paper material such as a corrugated cardboard, the folding line 6 provided on the surface material 10 may be referred to as a ruled line.

Deformed Form of Corner Protector 1A

Figure 2:
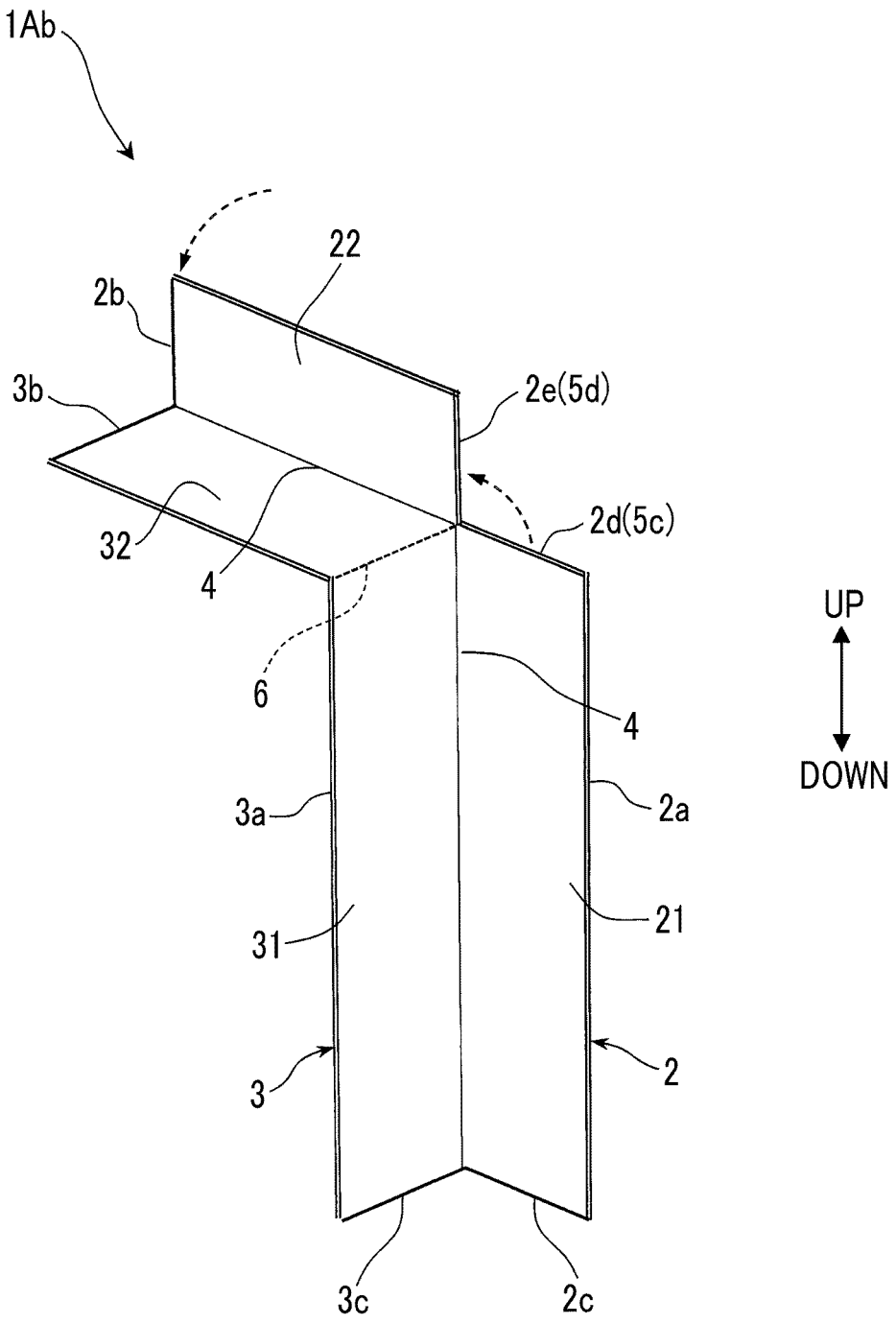
FIG. 2 is a perspective view showing a first deformed form of the corner protector of FIG. 1.

In the corner protector 1A, for example, in a case in which the surface portion 3 is folded along the folding line 6 at a substantially right angle, a corner protector 1Ab of a first deformed form shown in FIG. 2 can be obtained.

The corner protector 1Ab of the first deformed form is obtained by folding the surface portion 3 outward along the folding line 6 at a substantially right angle and retaining the surface portion 3. The folding of the surface portion 3 in this case is made possible by the existence of the notch 5 of the surface portion 2 that is continuously provided from one end of the folding line 6 intersecting the bent portion 4.

In the corner protector 1Ab of the first deformed form, the surface portion 3 is deformed into a shape in which the surface portion 3 is divided into a lower portion 31 that remains on the folding line 6 as a boundary, and an upper portion 32 that is bent at a substantially right angle to the lower portion 31.

In addition, in the corner protector 1Ab of the first deformed form, the surface portion 2 is deformed into a shape in which the surface portion 2 is divided into a lower portion 21 that remains by being separated by the notch 5, and an upper portion 22 that is tilted in a direction at a substantially right angle to the lower portion 21.

As shown in FIG. 2, a cut side 5*c* of a straight line separated by the notch 5 appears at the lower portion 21 of the surface portion 2 in this case. In addition, a cut side 5*d* of a straight line separated by the notch 5 appears at the upper portion 22 of the surface portion 2 in this case.

Figure 3A:
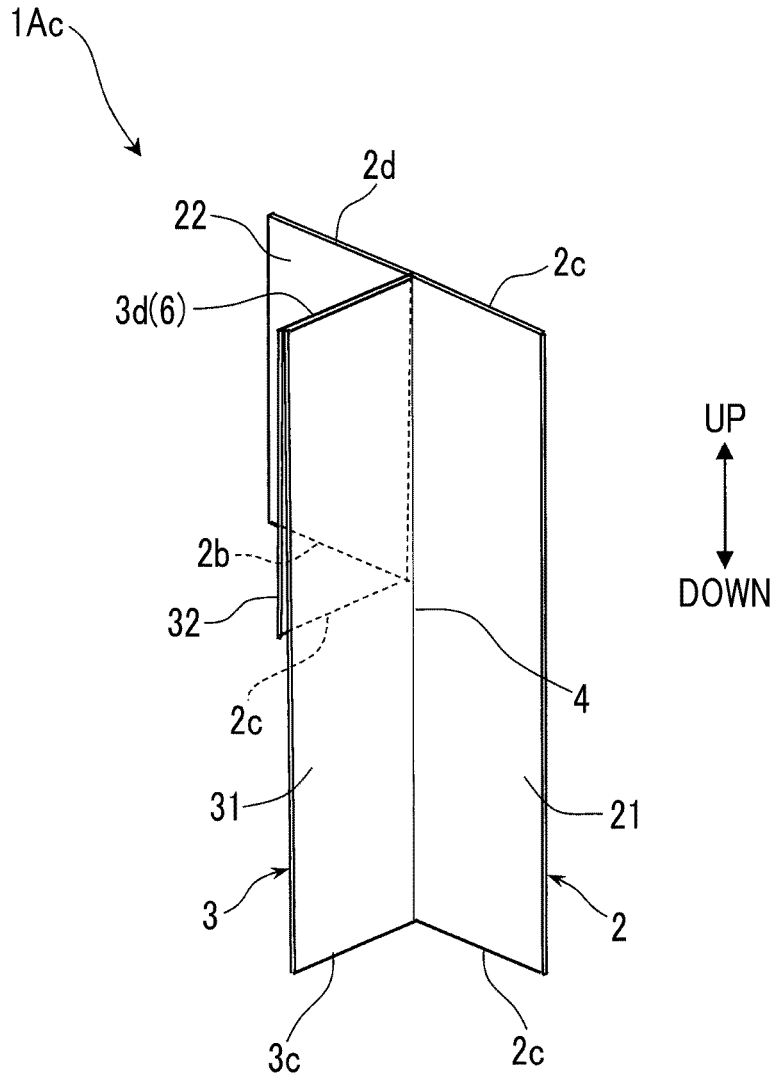
FIG. 3A is a perspective view showing a second deformed form of the corner protector of FIG. 1.

In addition, in the corner protector 1A, for example, in a case in which the surface portion 3 is folded back along the folding line 6, a corner protector 1Ac of a second deformed form shown in FIG. 3A can be obtained.

The corner protector 1Ac of the second deformed form is obtained by folding and folding back the surface portion 3 along the folding line 6 at an angle of substantially 180 degrees. The surface portion 3 in this case is formed not to be broken along the folding line 6.

In the corner protector 1Ac of the second deformed form, the surface portion 3 is deformed into a shape in which the lower portion 31 and the upper portion 32 overlap each other back to back with the folding line 6 interposed therebetween.

In addition, in the corner protector 1Ac of the second deformed form, the surface portion 2 is deformed into a shape in which the lower portion 21 and the upper portion 22 are adjacent to each other with the bent portion 4 interposed therebetween.

Figure 3B:
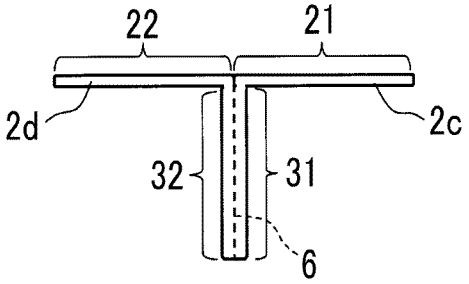
FIG. 3B is a top view showing a deformed form of the corner protector of FIG. 3A as viewed from above.

Further, the corner protector 1Ac of the second deformed form also has a form of a T-shaped portion as shown in FIG. 3B as viewed from above.

That is, the corner protector 1Ac as viewed from above has a T-shape in which the surface portion 3 having the shape in which the lower portion 31 and the upper portion 32 overlap each other and the surface portion 2 having the shape in which the lower portion 21 and the upper portion 22 are adjacent to each other intersect at a substantially right angle.

Use Example of Corner Protector 1A

The corner protector 1A can be used in a non-deformed form, as shown in FIGS. 4A and 4B. The non-deformed form is a form in which the surface portion 3 or the like is not deformed by folding.

The corner protector 1A of the non-deformed form is used, for example, by being abutted on each of four corners 100*a*, 100*b*, 100*c*, and 100*d* (see FIG. 4A) on the side surface of the loaded object 100 as shown in FIG. 4B.

In this case, the corner protector 1A is installed such that the four corners 100*a*, 100*b*, 100*c*, and 100*d* are abutted with the bent portion 4 as a reference.

In a case in which the corner protector 1A is used, finally, the packaging film 91 is wound around the side surface of the loaded object 100 including the corner protector 1A. The packaging film 91 is wound around, for example, the loaded object 100 while gradually shifting from the lower side surface periphery to the upper side surface periphery.

As a result, the corner protector 1A is kept in a state of being closely attached to each of the corners 100*a*, 100*b*, 100*c*, and 100*d* of the loaded object 100. In addition, the loaded object 100 is kept in a state in which the corners of the loads 101 at the corners of the loaded object 100 are covered with the corner protector 1A and are unlikely to move.

Therefore, in a case in which the corner protector 1A is used in the non-deformed form as described above, the occurrence of the load collapse at the four corners 100*a*, 100*b*, 100*c*, and 100*d*, which are examples of the corners of the loaded object 100, can be suppressed.

By the way, the corner protector 1A in this case may be used, for example, in a state in which an upper end (upper side) thereof remains at a position below an upper end of the loaded object 100 by a predetermined distance.

This is a measure for dealing with the fact that the load 101 of the loaded object 100 is compressed (reduced) in the up-down direction over time due to the influence of the weight and the like after the loading, and as a result, the total loading height of the loaded object 100 is lower than the initial height dimension.

As a result, even in a case in which the loading height of the loaded object 100 is lowered in the middle, the corner protector 1A can prevent a problem that the upper end thereof is in a state of being protruded from the loaded object 100.

In addition, the corner protector 1A of the non-deformed form can also be used, for example, by being abutted on the corner existing on the upper surface of the loaded object 100.

Next, the corner protector 1A can be used as the corner protector 1Ac of the second deformed form (see FIG. 3) as shown in FIGS. 4A and 4B.

The corner protector 1Ac of the second deformed form is used, for example, as shown in FIG. 4B, in a state of being abutted on at least a part of the corners of the loads 101 adjacent to each other in the up, down, right, and left directions inside the side surface of the loaded object 100.

More specifically, the corner protector 1Ac in this case is in a state in which a portion consisting of the lower portion 31 and the upper portion 32 that partially overlap each other due to folding back of the surface portion 3 forming a portion of the T-shaped portion is inserted between the adjacent loads 101 of the loaded object 100. In addition, the corner protector 1Ac in this case is in a state in which a portion consisting of the lower portion 21 and the upper portion 22 adjacent to each other obtained by separating the surface portion 2 forming a part of the T-shaped portion is abutted on a part of each side surface (front surface) of the adjacent loads 101.

In addition, as shown in FIG. 4B, in a case in which the loads 101 of the second stage from the bottom stacked at an inner position of one side surface of the loaded object 100 are to be started to be used, the corner protector 1Ac in this case is used as follows.

In this case, at a stage in which the loads 101 of the second stage as a target are loaded, the folded-back surface portion 3 of the corner protector 1Ac is inserted between the loads 101, and the entire corner protector 1Ac is installed in a self-supporting state. Thereafter, the loads 101 of the third and later stages are stacked on both sides of the corner protector 1Ac such that the folded-back surface portion 3 of the corner protector 1Ac is interposed therebetween.

In addition, in this case, in a case in which the loads 101 of the fourth and fifth stages are stacked, the side surfaces (front surfaces) of the loads 101 are covered with the surface portion 2 of a separated and adjacent form in the corner protector 1Ac.

Even in a case in which the corner protector 1Ac is used, finally, the packaging film 91 is wound around the side surface of the loaded object 100 including the corner protector 1Ac.

As a result, the corner protector 1Ac is kept in a state of being closely attached to a part of the load 101 that is loaded at a position inside the side surface of the loaded object 100. In addition, the loaded object 100 is kept in a state in which the corners of the loads 101 stacked in the up, down, right, and left directions inside the side surface of the loaded object 100 are covered with the corner protector 1Ac and are unlikely to move.

Therefore, in a case in which the corner protector 1Ac of the second deformed form is used in this way, the occurrence of the load collapse at the inner position, such as the center portion, of the loaded object 100 can be suppressed.

Figure 5:
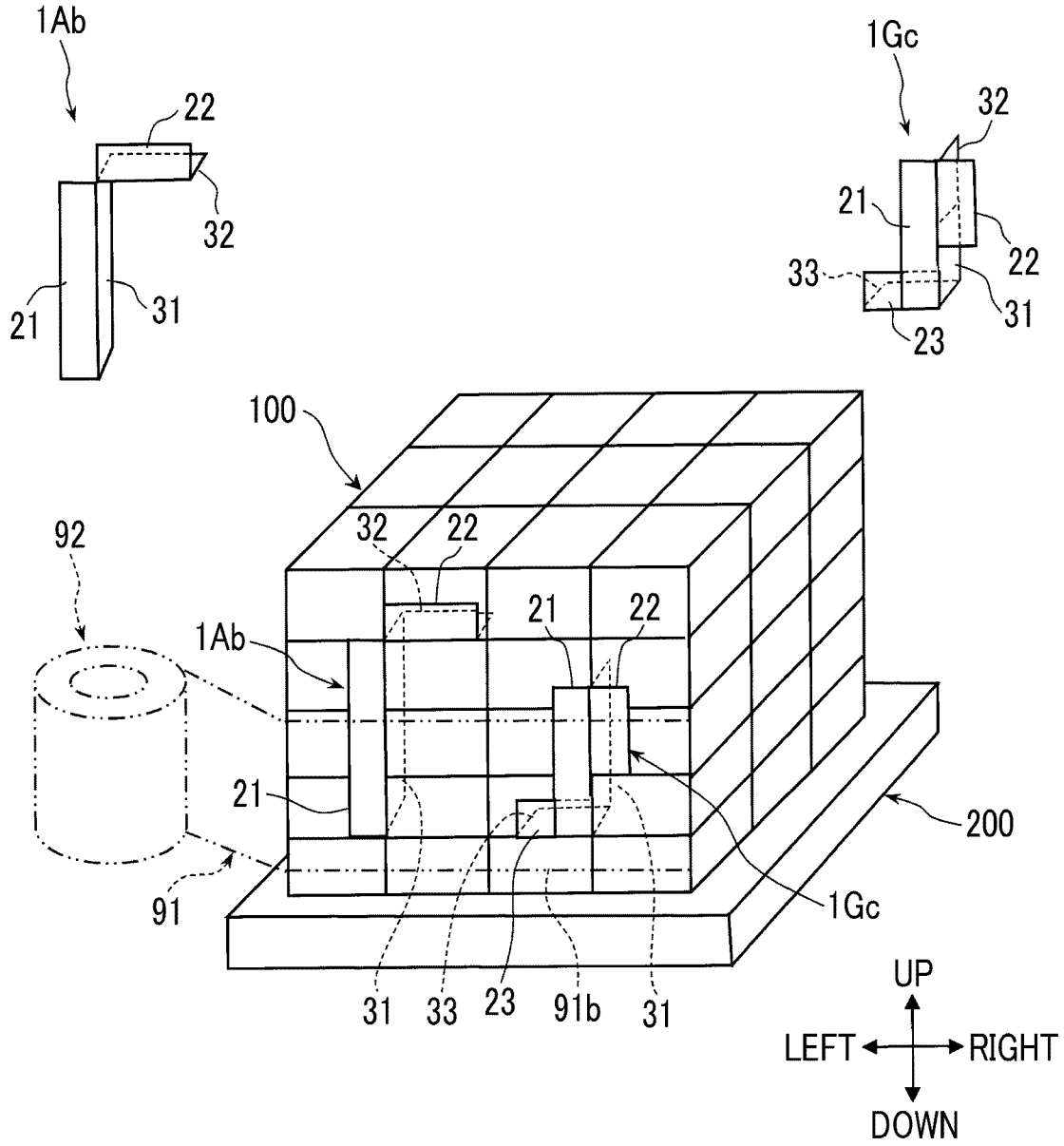
FIG. 5 is a schematic perspective view showing the loaded object and another corner protector.

In addition, the corner protector 1A can also be used as the corner protector 1Ab of the first deformed form (see FIG. 2) as shown in FIG. 5.

The corner protector 1Ab of the first deformed form is used, for example, as shown in FIG. 5, in a state of being abutted on at least a part of the corners of the loads 101 adjacent to each other in the up, down, right, and left directions inside the side surface of the loaded object 100, in a substantially identical manner to in a case of the corner protector 1Ac of the second deformed form.

More specifically, the corner protector 1Ab in this case is in a state in which the lower portion 31 and the upper portion 32 in a state of being folded at a substantially right angle along the folding line 6 of the surface portion 3 are inserted between the adjacent loads 101 of the loaded object 100. In addition, the corner protector 1Ab in this case is in a state in which the lower portion 21 and the upper portion 22, which are separated from each other by the notch 5 of the surface portion 2 and are in a positional relationship intersecting at a substantially right angle to each other, are abutted on a part of each side surface (front surface) of the adjacent loads 101.

In a case in which the corner protector 1Ab of the first deformed form is used, the occurrence of the load collapse at the inner position, such as the center portion, of the loaded object 100 can be suppressed in a substantially identical manner to in a case in which the corner protector 1Ac of the second deformed form is used.

Exemplary Embodiment 2

Figure 6:
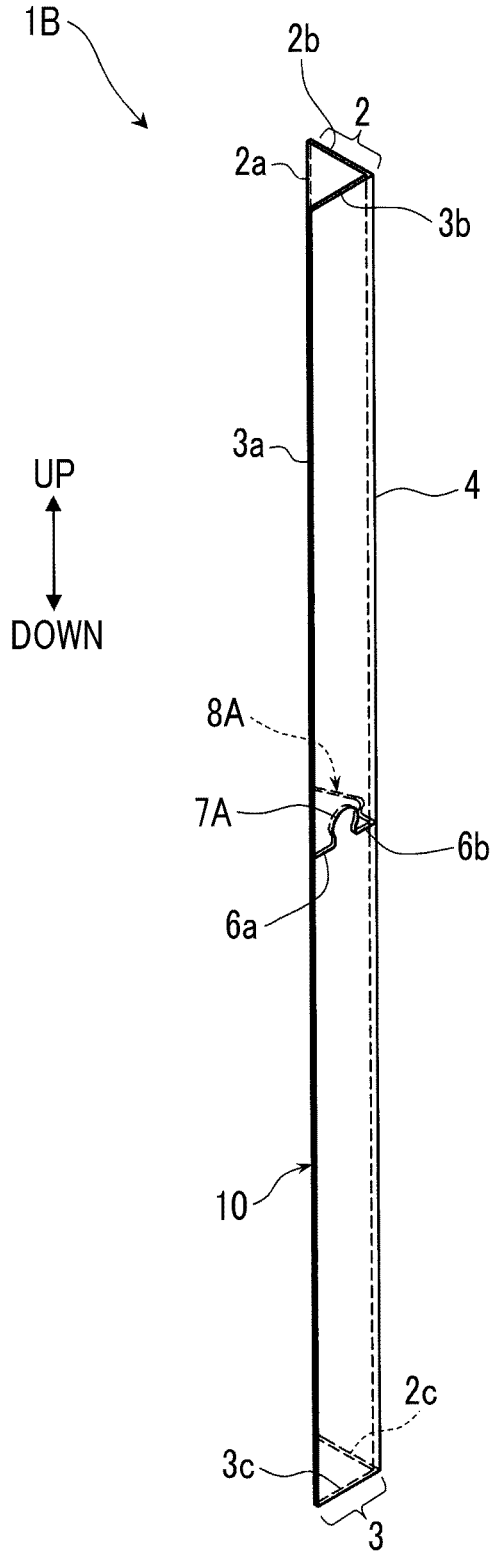
FIG. 6 is a perspective view of a corner protector according to Exemplary Embodiment 2.
Figure 7:
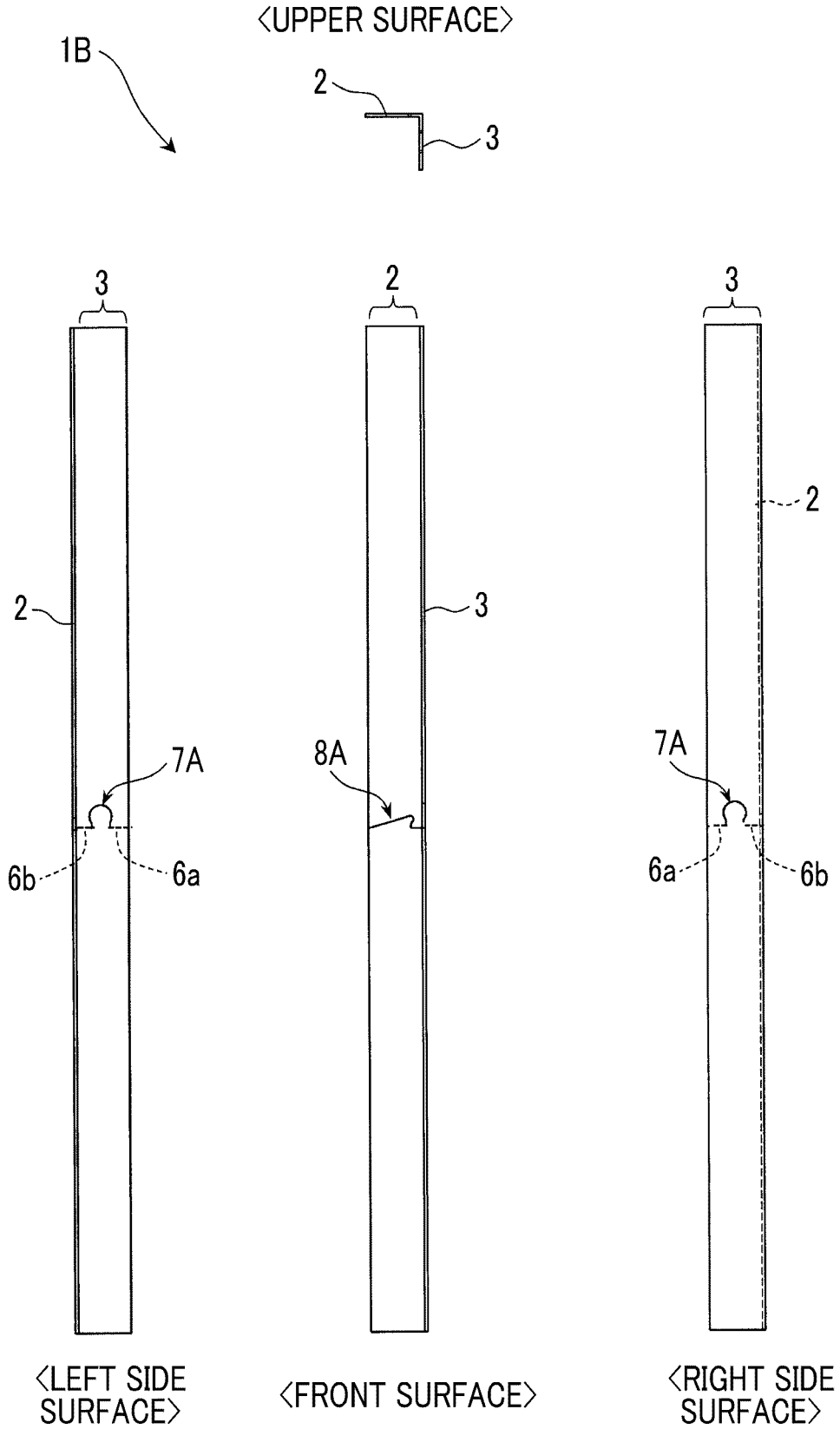
FIG. 7 is a four-sided view of the corner protector of FIG. 6.

FIGS. 6 and 7 are a perspective view and a four-sided view of a corner protector 1B according to Exemplary Embodiment 2 of the present invention.

The corner protector 1B according to Exemplary Embodiment 2 is different from the corner protector 1A according to Exemplary Embodiment 1 in that a second notch 7A is added and the notch 5 is changed to a third notch 8A, but consists of a substantially identical configuration to the corner protector 1A according to Exemplary Embodiment 1.

In addition, in the corner protector 1B, the third notch 8A and the folding line 6 are disposed at substantially center positions of the surface portions 2 and 3 in the upward direction, respectively. The upward direction of the surface portions 2 and 3 is also a longitudinal direction thereof.

The second notch 7A is a notch provided on the surface portion 3 by interrupting the folding line 6.

The second notch 7A can be said to be a linear notch that continuously extends from a first point on the folding line 6 to one of portions of the surface portion 3 with the folding line 6 as a boundary and then returns to a second point different from the first point on the folding line 6.

Reference numeral 6*a* in FIG. 6 or the like indicates an outer folding line portion of the folding line 6 that exists outside the second notch 7A that is interrupted by the second notch 7A. Reference numeral 6*b* indicates an inner folding line portion that exists inside the interrupted folding line 6. The line portion refers to a part of the entire line.

Figure 8:
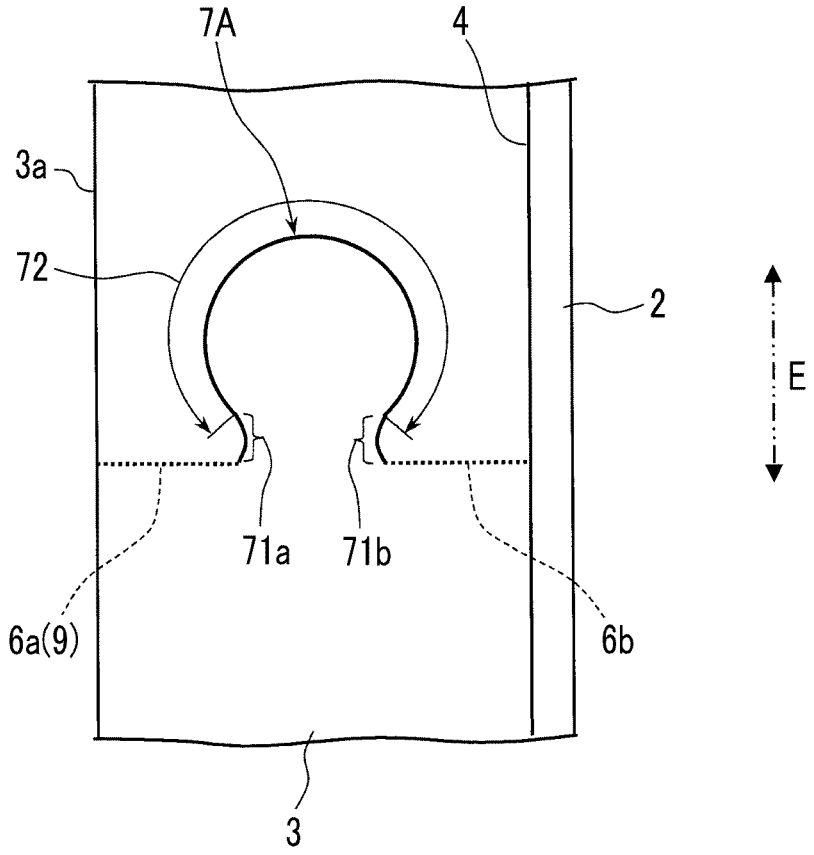
FIG. 8 is a schematic view showing a configuration of a second notch or the like of the corner protector of FIG. 6.

The second notch 7A in Exemplary Embodiment 2 is formed as a linear notch having a rising line portions 71*a* and 71*b* and a connecting line portion 72, as shown in FIG. 8.

The rising line portions 71*a* and 71*b* are line portions that rise upward at the interrupted points of the folding line 6.

Both the rising line portions 71*a* and 71*b* are line portions having the identical length and consisting of a curve that bends inward once. In addition, as shown in FIG. 8, the rising line portions 71*a* and 71*b* are also line portions consisting of curves extending to intersect a direction E parallel to the bent portion 4 at two or more different angles.

On the other hand, the connecting line portion 72 is a line portion that connects the upper ends of the rising line portions 71*a* and 71*b*.

The connecting line portion 72 is formed as a line portion consisting of a curve that is bent in an arc shape. In addition, the connecting line portion 72 is a line portion consisting of curves extending to intersect the direction E parallel to the bent portion 4 at two or more different angles.

In this way, the second notch 7A is a notch having three line portions extending to intersect the direction E parallel to the bent portion 4 at different angles. The line portions extending to intersect at different angles in the second notch 7A are the two rising line portions 71*a* and 71*b* and one connecting line portion 72.

The third notch 8A is a notch having a curved portion 81 instead of the notch 5 consisting of a straight line in Exemplary Embodiment 1.

Figure 9A:
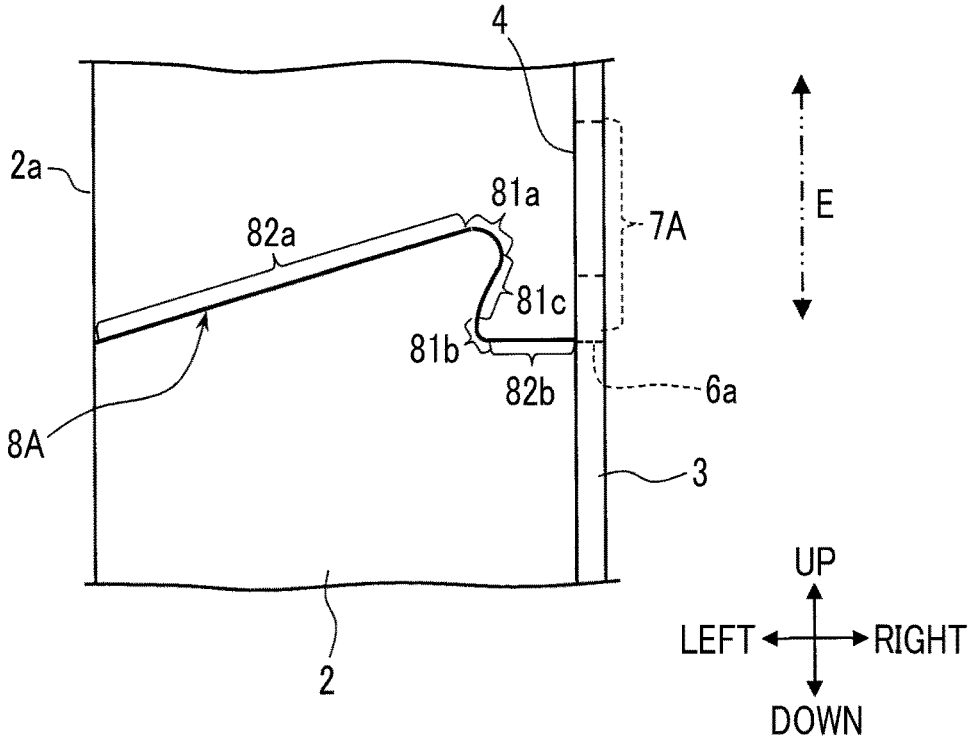
FIG. 9A is a schematic view showing a configuration of a third notch of the corner protector in FIG. 6.

The third notch 8A in Exemplary Embodiment 2 is formed as a notch consisting of a linear shape in which the curved portion 81 and a straight line portion 82 are combined, as shown in FIG. 9A.

The straight line portion 82 includes an inclined portion 82*a* and a horizontal portion 82*b*.

The inclined portion 82*a* is a straight line portion that is inclined from the lateral side 2*a*, which is also one side of the long sides of the surface portion 2, to a position close to the surface portion 3 in a right-upward direction in FIG. 9A.

The horizontal portion 82*b* is a straight line portion that extends horizontally along the right-left direction from the bent portion 4 to the vicinity of the lower side of the terminal end of the inclined portion 82*a*.

The curved portion 81 has a large curved portion 81*a*, a small curved portion 81*b*, and a connecting curved portion 81*c*.

The large curved portion 81*a* is an arc-shaped curved portion that is bent with a relatively large curvature to be connected to the terminal end of the inclined portion 82*a* of the straight line portion 82 and folded back downward.

The small curved portion 81*b* is an arc-shaped curved portion that is bent with a relatively small curvature to be connected to the terminal end of the horizontal portion 82*b* of the straight line portion 82 and folded back upward. The small curved portion 81*b* has a relationship in which the curvature thereof is smaller than the curvature of the large curved portion 81*a*.

The connecting curved portion 81*c* is an arc-shaped curved portion that is bent once toward a side of the lateral side 2*a* of the surface portion 2 to connect the lower end of the large curved portion 81*a* and the upper end of the small curved portion 81*b*.

In addition, the connecting curved portion 81*c* is formed as a curved portion consisting of an arc with the fulcrum of the bending along the folding line 6 of the surface portion 3 as the center, from the viewpoint of facilitating performing the separation movement at the third notch 8A of the surface portion 2 in a case of folding the surface portion 3.

Figure 9B:
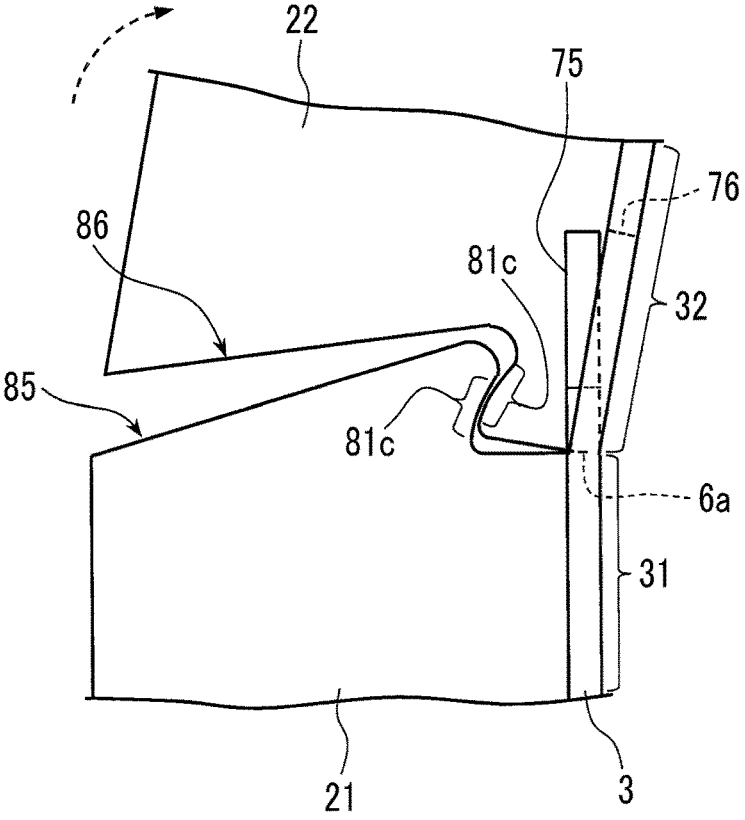
FIG. 9B is a schematic view showing a state of the third notch in a case in which the corner protector of FIG. 9A is folded.

The curved portion 81 including the connecting curved portion 81*c* is formed as a portion of a curve in which the movement trajectories in a case in which the surface portion 2 is separated into the lower portion 21 and the upper portion 22 by the third notch 8A do not overlap each other in a case in which the surface portion 3 is folded along the folding line 6. In the curved portion 81, as shown in FIG. 9B, the curved portion is formed as the arc-shaped curved portion so that the movement trajectories of the connecting curved portions 81*c* do not overlap each other.

The second notch 7A and the third notch 8A are formed by applying, for example, a press working method using a die, a working method using a blade such as a cutter, a laser working method, or the like. In addition, the method of forming the second notch 7A or the third notch 8A is not particularly limited.

Deformed Form of Corner Protector 1B

Figure 10A:
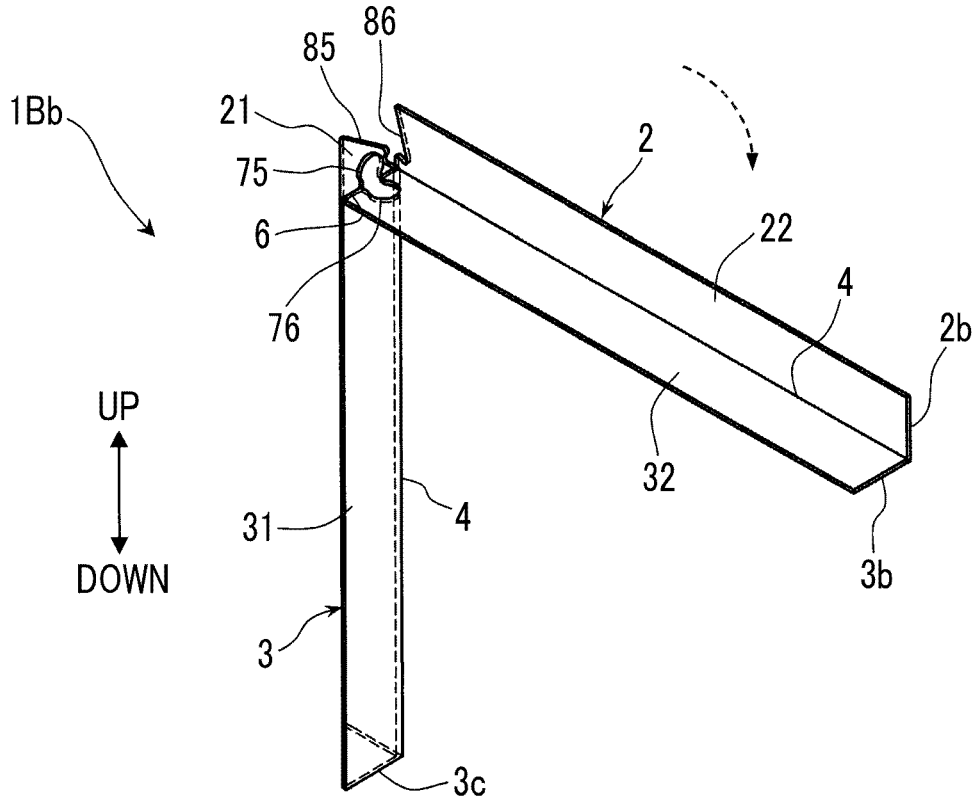
FIG. 10A is a perspective view showing a first deformed form of the corner protector of FIG. 6.
Figure 10B:
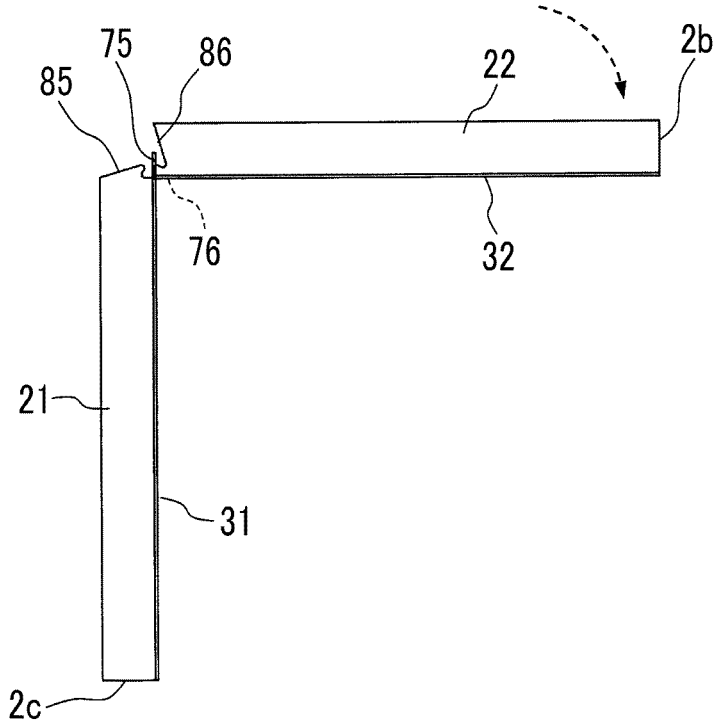
FIG. 10B is a front view of the form of FIG. 10A.

In the corner protector 1B, for example, in a case in which the surface portion 3 is folded along the folding line 6 at a substantially right angle, a corner protector 1Bb of a first deformed form shown in FIGS. 10A and 10B can be obtained.

The corner protector 1Bb of the first deformed form is obtained by folding the surface portion 3 outward along the folding line 6 at a substantially right angle and retaining the surface portion 3.

In the corner protector 1Bb of the first deformed form, the surface portion 3 is deformed into a shape in which the surface portion 3 is divided into the lower portion 31 and the upper portion 32 that are folded at a substantially right angle with the folding line 6 as a boundary and that are continuous with each other. The surface portion in this case is strictly folded at the outer folding line portion 6*a* and the inner folding line portion 6*b* of the folding line 6.

In addition, in the corner protector 1Bb of the first deformed form, the surface portion 2 is deformed into a shape in which the surface portion 2 is divided into the lower portion 21 and the upper portion 22 that are separated from each other at a substantially right angle by the second notch 7A.

In addition, in the corner protector 1Bb of the first deformed form, as shown in FIGS. 10A and 10B, a protruding portion 75 and a recess portion 76 having similar shapes and formed by the second notch 7A, appear in a portion folded along the folding line 6 of the surface portion 3.

The protruding portion 75 is a portion that protrudes from the lower portion 31 of the surface portion 3 and extends beyond the folding line 6.

The protruding portion 75 in Exemplary Embodiment 2 appears as a plate-like portion consisting of an outer appearance shape corresponding to the rising line portions 71*a* and 71*b* and the connecting line portion 72 of the second notch 7A shown in FIG. 8. Specifically, the protruding portion 75 is a portion in which a portion about two-thirds of an upper side thereof has a circular shape and a portion about one-third of a lower side thereof consists of an outer appearance shape in which the lower side is inwardly tapered.

The recess portion 76 is a recess that consists of a space of the upper portion 32 of the surface portion 3 remains after the protruding portion 75 is hollowed out with the folding line 6 as a boundary.

The recess portion 76 in Exemplary Embodiment 2 appears as a portion hollowed out in an outer appearance shape corresponding to the rising line portions 71*a* and 71*b* and the connecting line portion 72 of the second notch 7A shown in FIG. 8. In other words, the recess portion 76 is a recess portion consisting of a shape similar to the protruding portion 75 that remains after the protruding portion 75 is eliminated from the upper portion 32 of the surface portion 3.

In addition, in the corner protector 1Bb of the first deformed form, as shown in FIGS. 10A and 10B, opposite curved end portions 85 and 86 formed by the third notch 8A appear at the end portions of the lower portion 21 and the upper portion 22 separated by the third notch 8A of the surface portion 2.

In the corner protector 1Bb, the curved end portion 85 appears at the separated end portion of the lower portion 21 of the surface portion 2, and the curved end portion 86 appears at the separated end portion of the upper portion 22 of the surface portion 2.

Both the curved end portions 85 and 86 that appear on the surface portion 2 are end portions consisting of a shape having a curved portion corresponding to the linear shape of the third notch 8A.

The curved end portions 85 and 86 in Exemplary Embodiment 2 appear as end portions consisting of a linear shape in which the curved portion 81 and the straight line portion 82 of the third notch 8A shown in FIG. 9A are combined.

Specifically, the curved end portions 85, which is one curved end portion, is obtained as an end portion corresponding to a shape in which the large curved portion 81*a*, the small curved portion 81*b*, and the connecting curved portion 81*c* of the curved portion 81 shown in FIG. 9A, and the inclined portion 82*a* and the horizontal portion 82*b* of the straight line portion 82 are combined.

In addition, the curved end portion 86, which is the other curved end portion, is obtained as an end portion corresponding to the above-described combined shape, similarly to the curved end portion 85. The curved end portion 86 is obtained as an end portion having a shape opposite to the shape of the curved end portion 85 remaining after the curved end portion 85 is removed from the surface portion 2.

In the corner protector 1Bb, in a case in which the folding of the surface portion 3 along the folding line 6 causes the surface portion 2 to be separated into the lower portion 21 and the upper portion 22 with the third notch 8A as a boundary, the separation operation is easily performed.

That is, in the corner protector 1Bb, in a case in which the surface portion 2 is separated from the lower portion 21 and the upper portion 22, the movement trajectories of a part (the connecting curved portion 81*c*) of the curved portion 81 of the third notch 8A do not overlap each other and come into contact with each other. In addition, in a case of separating the surface portion 2 into the lower portion 21 and the upper portion 22, there is no need to perform, in advance, additional or pre-processing such as shifting the protruding portion at the curved end portion 85 to separate the surface portion 2 from the upper portion 32 of the surface portion 3.

In addition, in the corner protector 1B, for example, in a case in which the surface portion 3 is folded back along the folding line 6, a corner protector 1Bc of a second deformed form shown in FIG. 11A can be obtained.

The corner protector 1Bc of the second deformed form is obtained by folding and folding back the surface portion 3 along the folding line 6 at an angle of substantially 180 degrees. The surface portion 3 in this case is formed not to be broken at the outer folding line portion 6*a* and the inner folding line portion 6*b* of the folding line 6.

In the corner protector 1Bc of the second deformed form, the surface portion 3 is deformed into a shape in which the lower portion 31 and the upper portion 32 overlap each other back to back with the folding line 6 interposed therebetween.

In addition, in the corner protector 1Bc of the second deformed form, the surface portion 2 is deformed into a shape in which the lower portion 21 and the upper portion 22 are adjacent to each other with the bent portion 4 interposed therebetween.

Figure 12A:
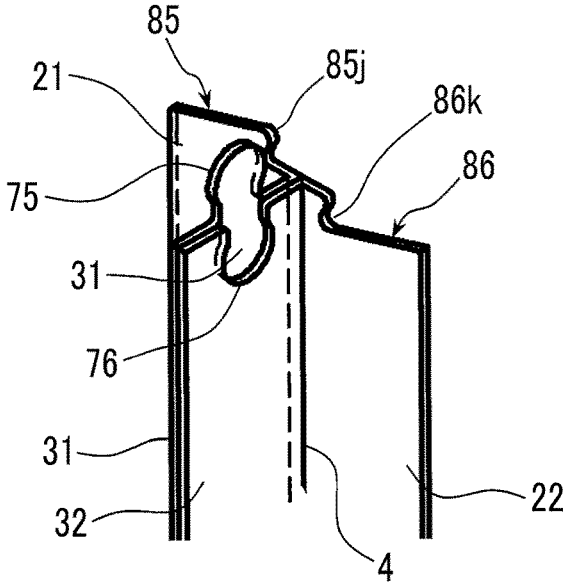
FIG. 12A is a side view showing a folded portion of the corner protector of the second deformed form of FIGS. 11A and 11B.
Figure 12B:
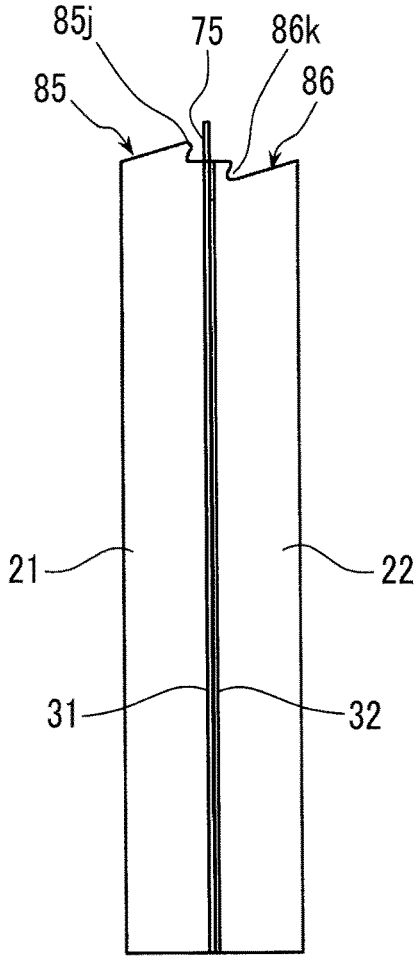
FIG. 12B is a front view showing the folded portion of FIG. 12A.

In addition, as shown in FIGS. 12A and 12B, the corner protector 1Bc of the second deformed form is in a state in which the protruding portion 75 appears at the folded end portion of the folded-back lower portion 31 of the surface portion 3, and the recess portion 76 having a shape similar to the protruding portion 75 appears at the folded end portion of the folded-back upper portion 32 thereof.

In this case, the protruding portion 75 and the recess portion 76 are obtained by the forming by the second notch 7A having the curved portion 81 having three line portions extending to intersect the direction E parallel to the bent portion 4 at different angles as described above.

Therefore, the protruding portion 75 and the recess portion 76 obtained by the forming by the second notch 7A also have external portions intersecting the direction E parallel to the bent portion 4 at different angles.

In addition, the recess portion 76 in this case is in a state in which the back side or the rear side thereof is blocked by the folded-back lower portion 31 of the surface portion 3.

Moreover, in the corner protector 1Bc of the second deformed form as well, as shown in FIGS. 12A and 12B, the curved end portion 85 appears at the separated end portion of the separated lower portion 21 of the surface portion 2, and the curved end portion 86 appears at the separated end portion of the separated upper portion 22.

The curved end portion 85 in this case is an end portion of a shape having a rounded convex portion 85*j* that protrudes obliquely upward as shown in FIGS. 12A and 12B. The convex portion 85*j* is a portion formed by the large curved portion 81*a* in the third notch 8A shown in FIG. 9A, a part of the inclined portion 82*a* that follows the large curved portion 81*a*, and the connecting curved portion 81*c*.

In addition, the curved end portion 86 in this case is an end portion of a shape having a rounded concave portion 86*k* that is recessed obliquely downward. The concave portion 86*k* is a portion mostly formed by the small curved portion 81*b*, the connecting curved portion 81*c*, and the horizontal portion 82*b* in the third notch 8A shown in FIG. 9A.

Further, the corner protector 1Bc of the second deformed form also has a form of a T-shaped portion as shown in FIG. 11B as viewed from above.

That is, the corner protector 1Bc as viewed from above also has a T-shape in which the surface portion 3 having the shape in which the lower portion 31 and the upper portion 32 overlap each other and the surface portion 2 having the shape in which the lower portion 21 and the upper portion 22 are adjacent to each other intersect at a substantially right angle.

Use Example of Corner Protector 1B

In a case of using the corner protector 1B alone, the corner protector 1B can be used in the identical manner to the corner protector 1A according to Exemplary Embodiment 1 (see FIG. 4).

That is, the corner protector 1B can be used in the non-deformed form (see FIG. 6) and can be used as the corner protector 1Bc of the second deformed form (see FIG. 11).

In this case, the corner protector 1B of the non-deformed form is used by being abutted on a necessary corner of the loaded object 100. In addition, the corner protector 1Bc of the second deformed form is used in a state of being abutted on at least a part of the corners of the loads 101 adjacent to each other in the up, down, right, and left directions inside the side surface of the loaded object 100.

In addition, in a case in which the corner protector 1B is used in the non-deformed form, in the identical manner to the corner protector 1A according to Exemplary Embodiment 1, the corner protector 1B can suppress the load collapse at the four corners 100*a*, 100*b*, 100*c*, and 100*d*, which are examples of the corners of the loaded object 100.

In addition, in a case in which the corner protector 1Bc of the second deformed form is used, in the identical manner to the corner protector 1Ac of the second deformed form according to Exemplary Embodiment 1, the occurrence of the load collapse at the inner position, such as the center portion, of the loaded object 100 can be suppressed.

Further, the corner protector 1Bb of the first deformed form can also be used in the identical manner to the corner protector 1Ab of the first deformed form according to Exemplary Embodiment 1 (see FIG. 5).

In this case, the corner protector 1Bb is used in a state of being abutted on at least a part of the corners of the loads 101 adjacent to each other in the up, down, right, and left directions inside the side surface of the loaded object 100.

Use Example of Corner Protectors 1B Connected to Each Other

In addition, the corner protector 1Bc of the second deformed form can be used, for example, in a state in which two corner protectors 1B are connected to each other, as shown in FIG. 13.

The connected state in this case is close to a temporary fixing state. In addition, the connected state can also be referred to as a joined state. This point is the identical in the following exemplary embodiments or modification examples.

FIG. 13 shows a case in which an upper corner protector 1Bc(K) disposed on the upper side is connected to a lower corner protector 1Bc(J) disposed on the lower side.

In the connection in this case, as shown in a part (B) in FIG. 13, a protruding portion 75A of the lower corner protector 1Bc(J) is fitted into a recess portion 76B of the upper corner protector 1Bc(K). In addition, in the connection in this case, a protruding portion 75B of the upper corner protector 1Bc(K) is fitted into a recess portion 76A of the lower corner protector 1Bc(J).

The corner protectors 1Bc(J) and 1Bc(K) are connected to each other by two types of the fitting between the protruding portions 75A and 75B and the recess portions 76B and 76A.

In this case, since the protruding portions 75A and 75B fitted into the recess portions 76B and 76A are in a state in which the back surface or the rear side of the recess portions 76B and 76A is blocked by the upper portion 32 of the surface portion 3 folded back as described above, the fitting is kept in a stable state.

In addition, in the connection in this case, as shown in the part (B) in FIG. 13, a curved end portion 86B of the lower corner protector 1Bc(J) and a curved end portion 85A of the upper corner protector 1Bc(K) are fitted together. In addition, a curved end portion 85B of the upper corner protector 1Bc(K) and a curved end portion 86A of the lower corner protector 1Bc(J) are fitted together.

The corner protectors 1Bc(J) and 1Bc(K) are also connected to each other by two types of fitting between the curved end portions 85A and 86A and the curved end portions 86B and 85B.

Further, the connection work of the two corner protectors 1Bc(J) and 1Bc(K) in this case is actually performed as follows.

That is, the connection operation in this case is performed by moving the curved end portion 86B and the curved end portion 85B of the upper corner protector 1Bc(K) slidingly to be fitted into the curved end portion 85A and the curved end portion 86A of the lower corner protector 1Bc(J) as shown in a part (A) in FIG. 14.

In the example shown in FIG. 14, the upper corner protector 1Bc(K) is moved downward obliquely with respect to the lower corner protector 1Bc(J) as indicated by an arrow S to be combined.

As a result, as shown in a part (B) in FIG. 14, in the lower corner protector 1Bc(J) and the upper corner protector 1Bc(K), the curved end portion 85A and the curved end portion 86A of the corner protector 1Bc(J) are fitted into the curved end portion 86B and the curved end portion 85B of the corner protector 1Bc(K), respectively.

Specifically, the curved end portion 85A is fitted with the curved end portion 86B by fitting the convex portion 85*j* thereof into the concave portion 86*k* (see FIGS. 12A and 12B) of the curved end portion 86B. In addition, the curved end portion 86A is fitted with the curved end portion 85B by fitting the convex portion 85*j* (see FIGS. 12A and 12B) of the curved end portion 85B into the concave portion 86*k* of the curved end portion 86A.

In addition, in this case of the connection, via the connection work described above, as shown in the part (B) in FIG. 14, the protruding portion 75A of the lower corner protector 1Bc(J) is fitted into the recess portion 76B of the upper corner protector 1Bc(K). In addition, substantially simultaneously, the protruding portion 75B of the upper corner protector 1Bc(K) is fitted into the recess portion 76A of the lower corner protector 1Bc(J).

Here, the protruding portions 75A and 75B, and the recess portions 76A and 76B have external portions intersecting the direction E parallel to the bent portion 4 at different angles.

Therefore, in a state in which the protruding portions 75A and 75B and the recess portions 76A and 76B are fitted to each other, even in a case in which an external tensile force is applied in the direction E that is parallel to the surfaces such as the protruding portions 75A and 75B and that is at least parallel to the bent portion 4, there is a portion in which the protruding portions 75A and 75B and the recess portions 76A and 76B collide with each other.

As a result, the protruding portions 75A and 75B and the recess portions 76A and 76B are the connecting means that is unlikely to come off or unlikely to be detached in the direction E that is at least parallel to the bent portion 4. In addition, the protruding portions 75A and 75B and the recess portions 76A and 76B are also connecting means that is unlikely to come off in all directions other than the direction E parallel to the bent portion 4 as long as the external force is parallel to the surfaces such as the protruding portions 75A and 75B.

Therefore, in the lower corner protector 1Bc(J) and the upper corner protector 1Bc(K) in the connected state, the connection via the fitting between the protruding portions 75A and 75B and the recess portions 76A and 76B as the connecting means described above is performed, so that a state is kept in which the connection is unlikely to be released.

In addition, in the lower corner protector 1Bc(J) and the upper corner protector 1Bc(K) in the connected state, the connection via the fitting between the curved end portions 85A and 86A and the curved end portions 86B and 85B is also performed, so that the state is kept in which the connection is unlikely to be released even in a case in which an external force is applied in the direction E parallel to the bent portion 4.

On the other hand, in a case in which a second notch 700A is adopted as in a corner protector 110B as a comparison target shown on a left side in FIG. 33A, the following results are obtained.

The second notch 700A in this case is a notch consisting of a linear shape of a polygonal line that extends in a tapered shape, and has two line portions 701 and 702. In addition, the second notch 700A has two line portions 701 and 702 as line portions intersecting the direction E parallel to the bent portion 4 at different angles.

In a case in which the corner protector 110B as the comparison target is folded back along the folding line 6, a corner protector 110Bc of a second deformed form shown on a right side in FIG. 33A is obtained.

In the corner protector 110Bc of the second deformed form, a protruding portion 750A and a recess portion 760A obtained by the forming by the second notch 700A appear.

However, in a case in which the protruding portion 750A and the recess portion 760A are used as the connecting means, the protruding portion 750A and the recess portion 760A are the connecting means that is likely to come off in the direction E that is at least parallel to the bent portion 4.

In addition, in a case in which a second notch 700B is adopted as in a corner protector 120B as a comparison target shown on a left side in FIG. 33B, the following results are obtained.

The second notch 700B in this case is a notch consisting of a linear shape of a polygonal line that is folded at a right angle twice, and has three line portions 711, 712, and 713. In addition, the second notch 700B has one line portion 713 as the line portions intersecting the direction E parallel to the bent portion 4 at different angles. The line portions 711 and 712 are line portions extending parallel to the direction E parallel to the bent portion 4.

In a case in which the corner protector 120B as the comparison target is folded back along the folding line 6, a corner protector 120Bc of a second deformed form shown on a right side in FIG. 33B is obtained.

In the corner protector 120Bc of the second deformed form, A protruding portion 750B and A recess portion 760B obtained by the forming by the second notch 700B as shown on a right side in FIG. 33B appear. In a case in which the protruding portion 750B and the recess portion 760B are used as the connecting means, the protruding portion 750B and the recess portion 760B are the connecting means that is likely to come off in the direction E that is at least parallel to the bent portion 4.

Exemplary Embodiment 3

FIGS. 15 and 16 are a perspective view and a four-sided view of a corner protector 1C according to Exemplary Embodiment 3 of the present invention.

The corner protector 1C according to Exemplary Embodiment 3 is different from the corner protector 1B according to Exemplary Embodiment 2 in that the third notch 8A is changed to another third notch 8B, but consists of a substantially identical configuration to the corner protector 1B according to Exemplary Embodiment 2.

The third notch 8B in Exemplary Embodiment 3 is formed as a notch consisting of a linear shape in which the curved portion 81 and the straight line portion 82 are combined, as shown in FIG. 17.

As shown in FIG. 17, the straight line portion 82 includes a first horizontal portion 82*c* and a second horizontal portion 82*d*.

The first horizontal portion 82*c* is a straight line portion extending horizontally and inwardly along the right-left direction from the lateral side 3*a*, which is also one side of the long sides of the surface portion 3, to one end of the curved portion 81 on the inner side.

The second horizontal portion 82*d* is a straight line portion extending horizontally and outwardly along the right-left direction from the bent portion 4 to the other end of the curved portion 81.

As shown in FIG. 17, the curved portion 81 has a first curved portion 81*d*, a second curved portion 81*e*, and a third curved portion 81*f*.

The first curved portion 81*d* is an arc-shaped curved portion extending in a curved manner to rise from the terminal end of the first horizontal portion 82*c* of the straight line portion 82 and approach the bent portion 4.

The second curved portion 81*e* is an arc-shaped curved portion extending in a curved manner to rise from the terminal end of the second horizontal portion 82*d* of the straight line portion 82 and approach the bent portion 4.

The third curved portion 81*f* is an arc-shaped curved portion extending in a bent manner to be connected to the upper end of the first curved portion 81*d* and the upper end of the second curved portion 81*e*.

In addition, the second curved portion 81*e* is formed as a curved portion consisting of an arc with the fulcrum of the bending along the folding line 6 of the surface portion 3 as the center, from the viewpoint of facilitating performing the separation movement at the third notch 8B of the surface portion 2 in a case of folding the surface portion 3.

Deformed Form of Corner Protector 1C

In the corner protector 1C, for example, in a case in which the surface portion 3 is folded along the folding line 6 at a substantially right angle, a corner protector 1Cb of a first deformed form shown in FIGS. 18A and 18B can be obtained.

In addition, in the corner protector 1Cb of the first deformed form, as in the corner protector 1Bb according to Exemplary Embodiment 2, as shown in FIGS. 18A and 18B, the protruding portion 75 and the recess portion 76 having the similar shapes and formed by the second notch 7A, appear in the portion folded along the folding line 6 of the surface portion 3.

In addition, in the corner protector 1Cb of the first deformed form, as shown in FIGS. 18A and 18B, opposite curved end portions 85C and 86C formed by the third notch 8B appear at the end portions of the lower portion 21 and the upper portion 22 separated by the third notch 8B of the surface portion 2.

Here, the curved end portion 85C appears at the separated end portion of the lower portion 21 of the surface portion 2, and the curved end portion 86C appears at the separated end portion of the upper portion 22 of the surface portion 2.

Both the curved end portions 85C and 86C that appear on the surface portion 2 are end portions consisting of a shape having a curved portion corresponding to the linear shape of the third notch 8B.

The curved end portions 85C and 86C in Exemplary Embodiment 3 appear as end portions consisting of a linear shape in which the curved portion 81 and the straight line portion 82 shown in FIG. 18B are combined.

Specifically, the curved end portions 85C, which is one curved end portion, is obtained as an end portion corresponding to a shape in which the first curved portion 81*d*, the second curved portion 81*e*, and the third curved portion 81*f* of the curved portion 81 shown in FIG. 17, and the first horizontal portion 82*c* and the second horizontal portion 82*d* of the straight line portion 82 are combined.

In addition, the curved end portion 86C, which is the other curved end portion, is obtained as an end portion corresponding to the above-described combined shape, similarly to the curved end portion 85C. The curved end portion 86C is obtained as an end portion having a shape opposite to the shape of the curved end portion 85C remaining after the curved end portion 85 is removed from the surface portion 2.

In the corner protector 1Cb as well, in a case in which the folding of the surface portion 3 along the folding line 6 causes the surface portion 2 to be separated into the lower portion 21 and the upper portion 22 with the third notch 8B as a boundary, the separation operation is easily performed.

That is, in the corner protector 1Cb, in a case in which the surface portion 2 is separated from the lower portion 21 and the upper portion 22, the movement trajectories of a part (the third curved portion 81*f* of the curved portion 81 of the third notch 8B do not overlap each other and come into contact with each other. In addition, in a case of separating the surface portion 2 into the lower portion 21 and the upper portion 22, there is no need to perform, in advance, additional or pre-processing such as shifting the protruding portion at the curved end portion 85C to separate the surface portion 2 from the upper portion 32 of the surface portion 3.

In addition, in the corner protector 1C, for example, in a case in which the surface portion 3 is folded back along the folding line 6, a corner protector 1Cc of a second deformed form shown in FIG. 19 can be obtained.

The corner protector 1Cc of the second deformed form is in a state in which the protruding portion 75 and the recess portion 76 having the similar shapes appear separately at the end portions of the lower portion 31 and the upper portion 32, which are folded back, of the surface portion 3, as in the corner protector 1Bc according to Exemplary Embodiment 2 of the present invention, as shown in FIG. 19.

In addition, as shown in FIG. 19, in the corner protector 1Cc of the second deformed form, the curved end portion 85C appears at the separated end portion of the separated lower portion 21 of the surface portion 2, and the curved end portion 86C appears at the separated end portion of the separated upper portion 22.

The curved end portion 85C in this case is an end portion of a shape having a rounded convex portion extending to protrude obliquely upward toward the side approaching the bent portion 4 as shown in FIG. 19. The convex portion is a portion mostly formed by the third curved portion 81*f* (FIG. 17) in the third notch 8B.

In addition, the curved end portion 86C in this case is an end portion of a shape having a rounded concave portion extending to be recessed obliquely downward toward the side approaching the bent portion 4. The concave portion is a portion mostly formed by the third curved portion 81*f* (FIG. 17) in the third notch 8B.

Further, the corner protector 1Cc of the second deformed form also has a T-shaped portion as viewed from above, as in the corner protector 1Bc according to Exemplary Embodiment 2.

That is, the corner protector 1Cc as viewed from above also has a T-shape in which the surface portion 3 having the shape in which the lower portion 31 and the upper portion 32 overlap each other and the surface portion 2 having the shape in which the lower portion 21 and the upper portion 22 are adjacent to each other intersect at a substantially right angle.

Use Example of Corner Protector 1C

In a case of using the corner protector 1C alone, the corner protector 1B can be used in the identical manner to the corner protector 1A according to Exemplary Embodiment 1 (see FIG. 4).

That is, the corner protector 1C can be used in the non-deformed form (see FIG. 15) and can be used as the corner protector 1Cc of the second deformed form (see FIG. 19).

In a case in which the corner protector 1C is used in this way, the identical effects to the effects in a case in which the corner protector 1B according to Exemplary Embodiment 2 is used can be obtained.

Further, the corner protector 1Cb of the first deformed form shown in FIGS. 18A and 18B can also be used in the substantially identical manner to the corner protector 1Ab of the first deformed form according to Exemplary Embodiment 1 (see FIG. 5).

In this case, the corner protector 1Cb is used in a state of being abutted on at least a part of the corners of the loads 101 adjacent to each other in the up, down, right, and left directions inside the side surface of the loaded object 100.

In addition, the corner protector 1Cc of the second deformed form can be used, for example, in a state in which two corner protectors 1C are connected (joined) to each other, as shown in FIG. 20.

FIG. 20 shows a case in which an upper corner protector 1Cc(K) disposed on the upper side is connected to a lower corner protector 1Cc(J) disposed on the lower side.

In the connection in this case, as shown in a part (B) in FIG. 20, the protruding portion 75A of the lower corner protector 1Cc(J) is fitted into the recess portion 76B of the upper corner protector 1Cc(K). In addition, in the connection in this case, the protruding portion 75B of the upper corner protector 1Cc(K) is fitted into the recess portion 76A of the lower corner protector 1Cc(J).

The corner protectors 1Cc(J) and 1Cc(K) are connected to each other by two types of the fitting between the protruding portions 75A and 75B and the recess portions 76B and 76A.

In addition, in the connection in this case, as shown in FIG. 20 or 21, the convex portion of the curved end portion 85Ca of the lower corner protector 1Cc(J) and the concave portion of the curved end portion 86Cb of the upper corner protector 1Cc(K) are fitted together. In addition, the convex portion of the curved end portion 85Cb of the upper corner protector 1Cc(K) and the concave portion at the curved end portion 86Ca of the lower corner protector 1Cc(J) are fitted together.

The corner protectors 1Cc(J) and 1Cc(K) are also connected to each other by two types of fitting between the curved end portions 85Ca and 86Ca and the curved end portions 86Cb and 85Cb.

Here, the protruding portions 75A and 75B and the recess portions 76A and 76B are the connecting means that is unlikely to come off or unlikely to be detached in the direction E that is at least parallel to the bent portion 4, as described above. In addition, the protruding portions 75A and 75B and the recess portions 76A and 76B are also connecting means that is unlikely to come off in all directions other than the direction E parallel to the bent portion 4 as long as the external force is parallel to the surfaces such as the protruding portions 75A and 75B.

Therefore, in the lower corner protector 1Cc(J) and the upper corner protector 1Cc(K) in the connected state, the connection via the fitting between the protruding portions 75A and 75B and the recess portions 76A and 76B as the connecting means described above is performed, so that a state is kept in which the connection is unlikely to be released.

In addition, the curved end portions 85Ca and 85Cb, and the curved end portions 86Ca and 86Cb have external portions intersecting the direction E parallel to the bent portion 4 at different angles.

Therefore, in a state in which the curved end portions 85Ca and 85Cb and the curved end portions 86Ca and 86Cb are fitted to each other, even in a case in which an external tensile force is applied in the direction E that is parallel to the surfaces such as the curved end portion 85Ca and 85Cb and that is at least parallel to the bent portion 4, there is a portion in which the curved end portions 85Ca and 85Cb and the curved end portions 86Ca and 86Cb collide with each other.

As a result, the curved end portions 85Ca and 85Cb and the curved end portions 86Ca and 86Cb are also the connecting means that is unlikely to come off or unlikely to be detached in the direction E that is at least parallel to the bent portion 4. In addition, the curved end portions 85Ca and 85Cb and the curved end portions 86Ca and 86Cb are also connecting means that is unlikely to come off in all directions other than the direction E parallel to the bent portion 4 as long as the external force is parallel to the surfaces such as the curved end portions 85Ca and 85Cb.

Therefore, in the lower corner protector 1Cc(J) and the upper corner protector 1Cc(K) in the connected state, the connection via fitting together or fitting between the curved end portions 85Ca and 85Cb, and the curved end portions 86Ca and 86Cb as the connecting means described above is also performed, so that a state is kept in which the connection is more unlikely to be released.

Exemplary Embodiment 4

FIGS. 22 and 23 are a perspective view and a four-sided view of a corner protector 1D according to Exemplary Embodiment 4 of the present invention.

The corner protector 1D according to Exemplary Embodiment 4 is different from the corner protector 1C (see FIG. 15) according to Exemplary Embodiment 3 in that A third notch 8C slightly different from another second notch 7B is adopted and changed, but consists of a substantially identical configuration to the corner protector 1C according to Exemplary Embodiment 3.

The second notch 7B in Exemplary Embodiment 4 is formed as a notch consisting of a polygonal line 73 that interrupts a folding line 6*d* that intrudes on the surface portion 2 by leaving and that crosses the surface portion 3, as shown in FIGS. 24A and 24B.

In addition, the polygonal line 73 of the second notch 7B is formed of three line portions of a descending oblique line portion 73*a*, a rising line portion 73*b*, and a horizontal line portion 73*c*.

The descending oblique line portion 73*a* of the polygonal line 73 is a descending oblique line descending from the lateral side 3*a*, which is the long side of the surface portion 3, toward the inside, and is a straight line portion extending to a position in front of the bent portion 4.

The rising line portion 73*b* of the polygonal line 73 is a straight line portion extending in the up-down direction parallel to the bent portion 4 from the terminal end (lower end) of the descending oblique line portion 73*a*. The rising line portion 73*b* extends to the identical height position as the start end (upper end) of the descending oblique line portion 73*a*.

The horizontal line portion 73*c* of the polygonal line 73 is a straight line portion extending along the right-left direction that is horizontal from the upper end of the rising line portion 73*b* to the bent portion 4.

The folding line 6*d* is formed to intrude on a part of the surface portion 2 from the terminal end of the horizontal line portion 73*c* of the polygonal line 73.

The third notch 8C in Exemplary Embodiment 4 is a notch consisting of a linear shape obtained by inverting the third notch 8B (see FIG. 17) in Exemplary Embodiment 3 up and down with the first horizontal portion 82*c* and the second horizontal portion 82*d*.

Therefore, the third notch 8C is a notch consisting of a liner shape in which the curved portion 81 having the first curved portion 81*d*, the second curved portion 81*e*, and the third curved portion 81*f*, and the straight line portion 82 having the first horizontal portion 82*c* and the second horizontal portion 82*d* are combined, in the identical manner to the third notch 8B in Exemplary Embodiment 3.

Deformed Form of Corner Protector 1D

In the corner protector 1D, in a case in which the surface portion 3 is folded back along the folding line 6*d*, a corner protector 1Dc of a second deformed form shown in FIG. 25 can be obtained.

As shown in FIG. 24B or 25, in the corner protector 1Dc of the second deformed form, a protruding portion 75D and a recess portion 76D having similar shapes and formed by the second notch 7B appear at the end portions of the lower portion 31 and the upper portion 32 of the surface portion 3 folded along the folding line 6*d*.

In this case, the recess portion 76D appears at the folded end portion of the lower portion 31. The protruding portion 75D appears at the folded end portion of the upper portion 32.

The protruding portion 75D is a portion having a shape protruding obliquely upward at an acute angle corresponding to the polygonal line 73 of the second notch 7B.

The recess portion 76D is a recess portion having a shape corresponding to the protruding portion 75D. Specifically, the recess portion 76D is a portion having a recessed shape that protrudes downward at an acute angle corresponding to the polygonal line 73 of the second notch 7B. In addition, the recess portion 76D exists such that the upper portion 32 of the surface portion 3 consisting of the protruding portion 75D covers the back side or the rear side thereof.

In addition, in the corner protector 1Dc of the second deformed form, as shown in FIGS. 25A and 25B, opposite curved end portions 85D and 86D formed by the third notch 8C appear at the end portions of the lower portion 21 and the upper portion 22 separated by the third notch 8C of the surface portion 2.

In the corner protector 1Dc, the curved end portion 86D appears at the separated end portion of the lower portion 21 of the surface portion 2, and the curved end portion 85D appears at the separated end portion of the upper portion 22 of the surface portion 2.

Both the curved end portions 85D and 86D are end portions consisting of a shape having a curved portion corresponding to the linear shape of the third notch 8C.

In addition, the curved end portion 85D is obtained as an end portion corresponding to a protruding shape in which the first curved portion 81*d*, the second curved portion 81*e*, and the third curved portion 81*f* of the curved portion 81 shown in FIG. 17, and the first horizontal portion 82*c* and the second horizontal portion 82*d* of the straight line portion 82 are combined.

Further, the curved end portion 86D, which is the other curved end portion, is obtained as an end portion corresponding to the above-described combined shape, similarly to the curved end portion 85D. The curved end portion 86D is obtained as an end portion having a shape opposite to the shape of the curved end portion 85D remaining after the curved end portion 85 is removed from the surface portion 2.

In addition, in the corner protector 1D, in a case in which the surface portion 3 is folded along the folding line 6*d* at a substantially right angle and retained, the corner protector of the first deformed form can be obtained in a substantially identical manner to the corner protector 1Cb of the first deformed form (see FIGS. 18A and 18B) of the corner protector 1C according to Exemplary Embodiment 3.

Use Example of Corner Protector 1D

In a case of using the corner protector 1D alone, the corner protector 1B can be used in the identical manner to in a case of the corner protector 1A according to Exemplary Embodiment 1 (see FIG. 4).

That is, the corner protector 1D can be used in the non-deformed form (see FIG. 22) and can be used as the corner protector 1Dc of the second deformed form (see FIG. 25).

In a case in which the corner protector 1D is used in this way, the identical effects to the effects in a case in which the corner protector 1B according to Exemplary Embodiment 2 is used can be obtained.

In addition, in the corner protector 1D, the corner protector of the first deformed form can also be used in the substantially identical manner to the corner protector 1Ab of the first deformed form according to Exemplary Embodiment 1 (see FIG. 5).

In addition, the corner protector 1Dc of the second deformed form can be used, for example, in a state in which two corner protectors 1D are connected (joined) to each other, as shown in FIG. 26.

FIG. 26 shows a case in which an upper corner protector 1Dc(K) disposed on the upper side is connected to a lower corner protector 1Dc(J) disposed on the lower side.

In the connection in this case, as shown in FIG. 26 or 27, a protruding portion 75Da of the lower corner protector 1Dc(J) is fitted into a recess portion 76Db of the upper corner protector 1Dc(K). In addition, in the connection in this case, a protruding portion 75Db of the upper corner protector 1Dc(K) is fitted into a recess portion 76Da of the lower corner protector 1Dc(J).

These types of fitting can be performed, for example, by moving the lower end of the upper corner protector 1Dc(K) to approach the upper end of the lower corner protector 1Dc(J).

The corner protectors 1Dc(J) and 1Dc(K) are connected to each other by two types of fitting between the protruding portions 75Da and 75Db and the recess portions 76Da and 76Db.

In addition, in the connection in this case, as shown in FIG. 26, the convex portion of the curved end portion 85Da of the lower corner protector 1Dc(J) and the concave portion of the curved end portion 86Db of the upper corner protector 1Dc(K) are fitted together. In addition, the convex portion of the curved end portion 85Db of the upper corner protector 1Dc(K) and the concave portion at the curved end portion 86Da of the lower corner protector 1Dc(J) are fitted together.

The corner protectors 1Dc(J) and 1Dc(K) are also connected to each other by two types of fitting between the curved end portions 85Da and 86Db and the curved end portions 86Da and 85Db.

Here, the curved end portions 85Da and 86Db, and the curved end portions 86Da and 85Db have external portions intersecting the direction E parallel to the bent portion 4 at different angles.

Therefore, in a state in which the curved end portions 85Da and 86Db and the curved end portions 86Da and 85Db are fitted to each other, even in a case in which an external tensile force is applied in the direction E that is parallel to the surfaces such as the curved end portion 85Da and 86Db and that is at least parallel to the bent portion 4, there is a portion in which the curved end portions 85Da and 86Db and the curved end portions 86Da and 85Db collide with each other.

As a result, the curved end portions 85Da and 86Db and the curved end portions 86Da and 85Db are the connecting means that is unlikely to come off or unlikely to be detached in the direction E that is at least parallel to the bent portion 4. In addition, the curved end portions 85Da and 86Db and the curved end portions 86Da and 85Db are also connecting means that is unlikely to come off in all directions other than the direction E parallel to the bent portion 4 as long as the external force is parallel to the surfaces such as the curved end portions 85Da and 86Db.

Therefore, in the lower corner protector 1Dc(J) and the upper corner protector 1Dc(K) in the connected state, the connection via fitting together or fitting between the curved end portions 85Da and 86Db and the curved end portions 86Da and 85Db as the connecting means described above is performed, so that the state is kept in which the connection is unlikely to be released.

MODIFICATION EXAMPLE

The present invention is not limited to the configuration described as Exemplary Embodiments 1 to 4, and various modifications, improvements, or combinations can be made without changing the gist of each invention described in the claims. Therefore, the present invention also includes, for example, the following modification examples.

Modification Example 1

The corner protector 1 may be a corner protector 1E to which a second notch 7C consisting of a polygonal line 74 shown on a left side in FIG. 28A is applied as the second notch 7.

The polygonal line 74 of the second notch 7C is a polygonal line having a first oblique line portion 74*a* and a second oblique line portion 74*b*.

The first oblique line portion 74*a* is a straight line portion extending obliquely upward to the right from the terminal end of the outer folding line portion 6*a*. The second oblique line portion 74*b* is a straight line portion extending obliquely upward from the terminal end (left end) of the first oblique line portion 74*a* and the inner folding line portion 6*b*.

The upper end of the first oblique line portion 74*a* is located at a position shifted from the point of the terminal end of the inner folding line portion 6*b* or the lower end of the second oblique line portion 74*b* in a direction approaching the bent portion 4 (right direction). The upper end of the first oblique line portion 74*a* is also the upper end of the second oblique line portion 74*b*.

Therefore, the second notch 7C can be said to be a notch consisting of a linear shape that is tilted and falls in to the right side, and protrudes at an acute angle. In addition, the second notch 7C is a notch having two line portions intersecting the direction E parallel to the bent portion 4 at different angles, that is, the first oblique line portion 74*a* and the second oblique line portion 74*b*.

In the corner protector 1E to which the second notch 7C is applied, in a case in which a case in which the surface portion 3 is folded and folded back along the folding line 6, a corner protector 1Ec of a second deformed form of which a part is shown a right side in FIG. 28A is obtained.

In the corner protector 1Ec of the second deformed form, as shown on the right side in FIG. 28A, a protruding portion 75E and a recess portion 76E having the similar shapes and formed by the second notch 7C appear at the folded-back end portion of the surface portion 3.

In addition, the protruding portion 75E and the recess portion 76E in this case are portions each having two line portions intersect the direction E parallel to the bent portion 4 at different angles. However, in a case in which the protruding portion 75E and the recess portion 76E receive an external force along the direction E parallel to the surface such as the protruding portion 75E and parallel to the bent portion 4, a portion corresponding to the first oblique line portion 74*a* and the second oblique line portion 74*b* of the polygonal line 74 is a portion that is unlikely to move.

Therefore, the corner protectors 1E in a state of being connected to each other by fitting the protruding portion 75E into the recess portion 76E are unlikely to come off or unlikely to be detached in the direction E parallel to the bent portion 4.

Modification Example 2

In addition, the corner protector 1 may be a corner protector 1F in which a second notch 7D consisting of a polygonal line 74 shown on a left side in FIG. 28B is applied as the second notch 7.

The polygonal line 74 of the second notch 7D is a polygonal line having a first oblique line portion 74*c*, a second oblique line portion 74*d*, and a horizontal line portion 74*e*.

The first oblique line portion 74*c* is a straight line portion extending obliquely upward to the left from the terminal end of the outer folding line portion 6*a*. The second oblique line portion 74*d* is a straight line portion extending obliquely upward to the right from the terminal end (left end) of the inner folding line portion 6*b*. The horizontal line portion 74*e* is a straight line portion that connects the upper end of the first oblique line portion 74*c* and the upper end of the second oblique line portion 74*d* and extends substantially horizontally.

The second notch 7D is a notch having two line portions intersecting the direction E parallel to the bent portion 4 at different angles, that is, the first oblique line portion 74*c* and the second oblique line portion 74*d*.

In the corner protector 1F to which the second notch 7D is applied, in a case in which a case in which the surface portion 3 is folded and folded back along the folding line 6, a corner protector 1Fc of a second deformed form of which a part is shown a right side in FIG. 28B is obtained.

In the corner protector 1Fc of the second deformed form, as shown on the right side in FIG. 28B, a protruding portion 75F and a recess portion 76F having the similar shapes and formed by the second notch 7D appear at the folded-back end portion of the surface portion 3.

In addition, the protruding portion 75F and the recess portion 76F in this case are portions each having two line portions intersect the direction E parallel to the bent portion 4 at different angles. However, in a case in which the protruding portion 75F and the recess portion 76F receive an external force along the direction E parallel to the surface such as the protruding portion 75F and parallel to the bent portion 4, a portion corresponding to the first oblique line portion 74*c* and the second oblique line portion 74*d* of the polygonal line 74 is a portion that is unlikely to move.

In particular, the protruding portion 75F and the recess portion 76F are oblique line portions in which the first oblique line portion 74*c* and the second oblique line portion 74*d* are inclined on opposite sides with respect to the parallel direction E. Therefore, in a case of fitting, the protruding portion 75F and the recess portion 76F are unlikely to come off or unlikely to be detached in the direction E parallel to the bent portion 4 as compared with a case of the protruding portion 75E and the recess portion 76E (see the right side in FIG. 28B).

As a result, the corner protectors 1F in a state of being connected to each other by fitting the protruding portion 75F into the recess portion 76F are unlikely to come off or unlikely to be detached in the direction E parallel to the bent portion 4.

Modification Example 3

Further, the corner protector 1 may be a corner protector 1G in which a notch 5C shown in FIG. 29 is applied as the notch 5 consisting of a straight line.

The notch 5C is provided, in addition to the notch 5 consisting of a horizontal straight line, as a notch consisting of the identical horizontal straight line at another portion of the surface portion 2.

In addition, in the corner protector 1G in this case, a folding line 6C consisting of a straight line extending substantially horizontally from the terminal end 5*b* of the notch 5C to the lateral side 3*a* of the surface portion 3 is provided.

That is, the corner protector 1G corresponds to the corner protector 1A according to Exemplary Embodiment 1 to which the notch 5C and the folding line 6C are added. Therefore, the corner protector 1G has the identical configuration to the corner protector 1A except for the added portion.

In the corner protector 1G, in a case in which the surface portion 3 is folded inward at a substantially right angle along the folding line 6C, a corner protector 1Gc of a third deformed form as shown in FIG. 30 is obtained.

In the corner protector 1Gc of the third deformed form, as shown in FIG. 30, by the folding along the folding line 6C, a bent lower portion 33 in which a lower side portion of the lower portion 31 of the surface portion 3 is bent at a substantially right angle is obtained.

In addition, in the corner protector 1Gc of the third deformed form, as shown in FIG. 30, a lower side portion of the lower portion 21 of the surface portion 2 is separated by the notch 5C to obtain a bent lower portion 23 that is bent at a right angle and partially overlaps. In FIG. 30, a portion shown by a halftone dot is an overlapping portion.

In addition, in a case in which the overlapping portion is not to be generated in the corner protector 1Gc of the third deformed form, the corner protector 1G may be a corner protector in which a triangular cutout portion 80 shown by a two-dot chain line in FIG. 29 is provided instead of the linear notch 5C.

The cutout portion 80 is formed of cut lines 56 and 57 consisting of two straight lines that come into contact with the bent portion 4 at an angle of 45 degrees and intersect each other at an angle of 90 degrees.

The corner protector 1Gc obtained by deforming, by folding along the folding line 6C, the corner protector 1G of the modification example in which the cutout portion 80 is provided is as follows. That is, in the corner protector 1Gc, in a case in which the surface portion 3 is folded along the folding line 6C, as shown by a two-dot chain line in FIG. 30, the surface portion 2 is only in a state in which the end portions of the two cut lines 56 and 57 forming the cutout portion 80 face each other, and the overlapping portion is not generated.

By the way, instead of providing the cutout portion 80 from the beginning, a configuration may be adopted in which the cut lines 56 and 57 on which the cutout portion 80 is to be formed are formed in advance as cuttable lines such as perforated lines. In this case, the notch 5C is also formed in the corner protector 1G.

In this case, in a case in which the corner protector 1G is folded along the folding line 6C and deformed to form the corner protector 1Gc, the following measures can be taken in a case in which there are circumstances that the overlapping portion formed due to the notch 5C is not to be generated.

That is, in the corner protector 1G in this case, in a stage of being used, the cutout portion 80 appears by cutting out a part of the surface portion 2 along the cuttable lines as the cut lines 56 and 57. As a result, the overlapping portion is not generated in the corner protector 1Gc obtained by deforming the corner protector 1G in this case.

The corner protector 1Gc of the third deformed form is used, for example, as shown in FIG. 5, in a state of being abutted on at least a part of the corners of the loads 101 adjacent to each other in the up, down, right, and left directions inside the side surface of the loaded object 100, in a substantially identical manner to in a case of the corner protector 1Ac of the second deformed form according to Exemplary Embodiment 1.

More specifically, the corner protector 1Gc in this case is in a state in which the lower portion 31 and the upper portion 32 of the surface portion 3 are inserted between the adjacent loads 101 of the loaded object 100. In addition, the corner protector 1Gc in this case is in a state in which the lower portion 21 and the upper portion 22 of the surface portion 2 and are in a positional relationship intersecting at a substantially right angle to each other, are abutted on a part of each side surface (front surface) of the adjacent loads 101.

In addition, the corner protector 1Gc is in a state in which the bent lower portion 33 of the lower portion 31 of the surface portion 3 in a state of being bent at a substantially right angle is inserted between the upper and lower loads 101. In addition, the corner protector 1Gc in this case can be in a state in which the bent lower portion 23 of the lower portion 21 of the surface portion 2 in a state of being bent at a substantially right angle is abutted on a part of the side surface of the load 101 on the bent lower portion 33.

In a case in which the corner protector 1Gc according to the third deformed form is used, as compared with a case in which the corner protector 1Ac of the second deformed form according to Exemplary Embodiment 1 is used, the occurrence of the load collapse at the inner position, such as the center portion, of the loaded object 100 can be further reliably suppressed.

Modification Example 4

As shown in FIG. 8, in the folding line 6, the outer folding line portion 6*a* which is a part thereof may be formed as the fourth notch 9.

In a case in which the outer folding line portion 6*a* is the fourth notch 9, for example, in a case in which the corner protector 1B is bent along the folding line 6 (actually, the inner folding line portion 6*b*), the protruding portion 75 and the recess portion 76 are easily separated and appear.

Modification Example 5

A plurality of the notches 5, the folding lines 6, the second notches 7, the third notches 8, and the like may be provided in one corner protector.

Modification Example 6

In a case in which the corner protector 1B and the like provided with the second notch 7 and the third notch 8 according to the exemplary embodiment of the present invention are connected as the corner protector 1Bc of the second deformed form, as shown in FIGS. 31A and 31B, a half-split corner protector 1Bc(M) may be used as one of the corner protectors 1Bc.

The half-split corner protector 1Bc(M) is, for example, as shown in FIGS. 31A and 31B, a corner protector in a form in which the lower portion 21 of the surface portion 2 is cut out or a corner protector in a form that is not used for connection.

As shown in FIGS. 31A and 31B, the half-split corner protector 1Bc(M) can be connected to the corner protector 1Bc(J) disposed below from above.

In the connection in this case, first, the protruding portion 75A of the lower corner protector 1Bc(J) is fitted into the recess portion 76B of the upper half-split corner protector 1Bc(M). In addition, in the connection in this case, the protruding portion 75B of the upper half-split corner protector 1Bc(M) is fitted into the recess portion 76A of the lower corner protector 1Bc(J).

Further, in this connection, the curved end portion 86B of the upper half-split corner protector 1Bc(M) and the curved end portion 85A of the lower corner protector 1Bc(J) are fitted together.

As a result, the half-split corner protector 1Bc(M) and the corner protector 1Bc(J) are connected to each other by two types of fitting between the protruding portions 75A and 75B and the recess portions 76B and 76A, and one type of fitting between the curved end portion 85A and the curved end portion 86B.

Modification Example 7

In addition, all of the corner protectors 1A and the like according to the exemplary embodiment of the present invention may be configured such that, as represented by the corner protector 1A shown in FIG. 32, the surface material 10A serving as the base material is not folded in advance at the bent portion 4, and is used in a shape of being folded at the bent portion 4 during use.

In addition, the corner protector according to the exemplary embodiment of the present invention is preferably produced by using, for example, one sheet of the surface material 10 made of paper. However, the corner protector according to the exemplary embodiment of the present invention may be produced by using the surface material 10 of another material as long as the surface material is foldable.

Examples of the surface material 10 made of paper include a surface material consisting of corrugated cardboard paper, thick paper, and corrugated plastic (a plastic corrugated cardboard material).

Supplementary Note (((1)))

A corner protector comprising:

two surface portions having a rectangular shape and interposing a bent portion extending parallel to one side;

a notch reaching the bent portion from one side of at least one surface portion of the two surface portions; and a folding line reaching one side of the other surface portion from a terminal end of the notch.

(((2)))

The corner protector according to (((1))), wherein, in the other surface portion, the folding line is interrupted and a second notch is provided.

(((3)))

The corner protector according to (((2))), wherein the second notch is a notch consisting of a continuous polygonal line.

(((4)))

The corner protector according to (((2))), wherein the second notch is a notch having three or more line portions extending to intersect a direction parallel to the bent portion at different angles.

(((5)))

The corner protector according to (((4))), wherein the second notch is a notch having a curved portion.

(((6)))

The corner protector according to (((2))), wherein, in a case in which the other surface portion is folded along the folding line, a protruding portion and a recess portion having similar shapes and formed by the second notch with the folding line interposed therebetween appear in a folded-back portion of the other surface portion.

(((7)))

The corner protector according to (((6))), wherein, in a case in which two corner protectors are used, the two corner protectors are in a state of being connected to each other by fitting the protruding portion of one corner protector into the recess portion of the other corner protector, and fitting the protruding portion of the other corner protector into the recess portion of the one corner protector.

(((8)))

The corner protector according to any one of (((1))) to (((7))), wherein the notch is formed as a third notch having a curved portion.

(((9)))

The corner protector according to (((8))), wherein the curved portion is a portion consisting of curves of which movement trajectories do not overlap each other in a case in which the other surface portion is folded along the folding line.

(((10)))

The corner protector according to (((8))), wherein, in a case in which the other surface portion is folded along the folding line, end portions of the one surface portion separated by the third notch appear as opposite curved end portions formed by the third notch.

(((11)))

The corner protector according to (((10))), wherein, in a case in which two corner protectors are used, the two corner protectors are in a state of being connected to each other by combining and fitting together the curved end portion of one corner protector and the curved end portion of the other corner protector.

(((12)))

The corner protector according to any one of (((2))) to (((11))), wherein a portion of the folding line from the one side of the other surface portion to the second notch is formed as a fourth notch.

(((13))) The corner protector according to any one of (((1))) to (((12))), wherein the corner protector is formed of one sheet of a surface material that is foldable.

(((14)))

The corner protector according to (((13))), wherein the surface material is a material made of paper.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A corner protector comprising:

two surface portions having a rectangular shape and interposing a bent portion extending parallel to one side;

a notch reaching the bent portion from one side of at least one surface portion of the two surface portions; and a folding line reaching one side of the other surface portion from a terminal end of the notch along a direction perpendicular to an extending direction of the bent portion, wherein, in the other surface portion, the folding line is interrupted and a second notch is provided, the second notch having at least a shape or an extending direction different from that of the folding line and that of the notch.

2. The corner protector according to claim 1, wherein the second notch is a notch consisting of a continuous polygonal line.

3. The corner protector according to claim 1, wherein the second notch is a notch having three or more line portions extending to intersect a direction parallel to the bent portion at different angles.

4. The corner protector according to claim 3, wherein the second notch is a notch having a curved portion.

5. The corner protector according to claim 1, wherein, in a case in which the other surface portion is folded along the folding line, a protruding portion and a recess portion having similar shapes and formed by the second notch with the folding line interposed therebetween appear in a folded-back portion of the other surface portion.

6. The corner protector according to claim 5, wherein, in a case in which two corner protectors are used, the two corner protectors are in a state of being connected to each other by fitting the protruding portion of one corner protector into the recess portion of the other corner protector, and fitting the protruding portion of the other corner protector into the recess portion of the one corner protector.

7. The corner protector according to claim 1, wherein the notch is formed as a third notch having a curved portion.

8. The corner protector according to claim 7, wherein the curved portion is a portion consisting of curves of which movement trajectories do not overlap each other in a case in which the other surface portion is folded along the folding line.

9. The corner protector according to claim 7,
wherein, in a case in which the other surface portion is folded along the folding line, end portions of the one surface portion separated by the third notch appear as opposite curved end portions formed by the third notch.

10. The corner protector according to claim 9,
wherein, in a case in which two corner protectors are used, the two corner protectors are in a state of being connected to each other by combining and fitting together the curved end portion of one corner protector and the curved end portion of the other corner protector.

11. The corner protector according to claim 1,
wherein a portion of the folding line from the one side of the other surface portion to the second notch is formed as a fourth notch.

12. The corner protector according to claim 1,
wherein the corner protector is formed of one sheet of a surface material that is foldable.

13. The corner protector according to claim 2,
wherein the corner protector is formed of one sheet of a surface material that is foldable.

14. The corner protector according to claim 3,
wherein the corner protector is formed of one sheet of a surface material that is foldable.

15. The corner protector according to claim 4,
wherein the corner protector is formed of one sheet of a surface material that is foldable.

16. The corner protector according to claim 5,
wherein the corner protector is formed of one sheet of a surface material that is foldable.

17. The corner protector according to claim 6,
wherein the corner protector is formed of one sheet of a surface material that is foldable.

18. The corner protector according to claim 12,
wherein the surface material is a material made of paper.

* * * * *